US005607812A

United States Patent [19]

Naito et al.

[11] Patent Number: 5,607,812

[45] Date of Patent: Mar. 4, 1997

[54] COLOR DIFFUSION TRANSFER FILM UNIT

[75] Inventors: Hideki Naito; Hiroki Sasaki, both of Kanagawa, Japan

[73] Assignee: Fuji Photo Film Co., Ltd., Kanagawa, Japan

[21] Appl. No.: 394,495

[22] Filed: Feb. 27, 1995

[30] Foreign Application Priority Data

Feb. 28, 1994 [JP] Japan ..... 6-052528
Nov. 7, 1994 [JP] Japan ..... 6-295954

[51] Int. Cl.[6] ..... G03C 8/10; G03C 8/52; G03C 8/56; G03C 8/36

[52] U.S. Cl. ..... 430/214; 430/215; 430/220; 430/222; 430/628; 430/546

[58] Field of Search ..... 430/214, 220, 430/222, 546, 628, 215

[56] References Cited

U.S. PATENT DOCUMENTS

| | | | |
|---|---|---|---|
| 3,721,555 | 3/1973 | Becker et al. | 430/220 |
| 4,198,478 | 4/1980 | Yoneyama et al. | 430/222 |
| 4,284,709 | 8/1981 | Tomka | 430/222 |
| 4,291,113 | 9/1981 | Minamizono et al. | 430/546 |
| 4,935,338 | 6/1990 | Masuda et al. | 430/628 |
| 5,112,720 | 5/1992 | Karino et al. | 430/214 |
| 5,194,361 | 3/1993 | Taguchi | 430/214 |
| 5,300,418 | 4/1994 | Visconte et al. | 430/222 |
| 5,360,695 | 11/1994 | Texter | 430/546 |
| 5,447,818 | 9/1995 | Naruse et al. | 430/214 |

OTHER PUBLICATIONS

"Photographic processes and products", *Research Disclosure* No. 15162, Nov. 1976, pp. 75–87.

*Primary Examiner*—Richard L. Schilling
*Attorney, Agent, or Firm*—Sughrue, Mion, Zinn, Macpeak & Seas

[57] ABSTRACT

A color diffusion transfer film unit containing an alkali processing element as one of elements constituting the film unit, wherein at least one of the elements contains at least one oligomer or polymer having surface activity. The film unit can contain a small amount of a photographically useful substance in a stable state. The film unit forms a clear image at a high rate of image formation.

10 Claims, No Drawings

COLOR DIFFUSION TRANSFER FILM UNIT

FIELD OF THE INVENTION

This invention relates to a color diffusion transfer film unit and more particularly to a color diffusion transfer film unit which provides a clear color image at a high rate of image formation.

BACKGROUND OF THE INVENTION

Known color diffusion transfer film units are divided into a peel-apart type and a monosheet type (non-peel type). The peel-apart type film unit is composed of a light-sensitive element and a dye-receiving element on separate supports. After imagewise exposure, the light-sensitive element and the image-receiving element are brought into contact, a processing solution is spread therebetween, and the dye image-receiving element is peeled off to obtain a dye image transferred on the dye image-receiving layer.

The monosheet type film units comprise a pair of substrates one of which is transparent, between which a dye image-receiving element, a light-sensitive element, and a neutralization timing element are provided. The light-sensitive element may be provided on the same transparent support on which the dye-image receiving element is provided, or may be provided on the separate support. In the former case, a white reflecting layer is provided between the image-receiving element and the light-sensitive element, and in the latter case a processing solution to be spread between the image-receiving element and the light-sensitive element contains a white pigment, so that the dye image transferred to the image-receiving layer may be seen by reflected light.

A color diffusion transfer system using an alkali processing composition as one of the elements constituting the film unit has a disadvantage that a highly sharp image is hardly obtained; because the distance of diffusion of a dye generated is long, the system involves fixing of the dye, and the black or white pigment used in a light-shielding layer or in a white background layer acts as resistance against diffusion.

In such an image formation system including diffusion and fixing of a dye, it is important to minimize the distance of diffusion of the formed dye, that is, the thickness of the film unit, in order to obtain a clear image in a short time. In order to achieve this, it is effective to reduce the amount of a binder that is resistance against dye diffusion and/or to develop a photographically useful substance that would function at a low amount of addition. Development of a technique enabling reduction of film thickness has been a subject for not only a color diffusion transfer system but other photographic systems.

Pigments usually used in color diffusion transfer film units, such as carbon black and titanium white, are very apt to agglomerate, causing such fatal problems as a leak of light or white background stains. To avoid these problems, it has been a practice to use these pigments or a binder in amounts more than necessary, which has made it difficult to reduce the film thickness. Any means other than thickness reduction taken to accelerate image formation would deteriorate the image sharpness.

It has therefore been demanded to develop a technique for reduction in film thickness or a technique for increasing the rate of dye diffusion to obtain a clear image in a reduced time.

It has been proposed to incorporate a tertiary amine polymer latex into a color diffusion transfer film unit as a photographically useful substance for improving sharpness and the like. After a transfer image is formed, and the pH of the system decreases, the amine moiety of the tertiary amine polymer latex becomes capable of capturing the residual dye which lags behind in the transfer, considerably suppressing an unnecessary increase in image density after image formation. The tertiary amine polymer having such an action can be used in any of light-sensitive layers and a mordanted layer. However, the tertiary amine polymer latex has poor stability and easily coagulates to reduce filterability. Therefore, there has been a demand to develop a technique to improve the stability of the tertiary amine polymer latex.

SUMMARY OF THE INVENTION

An object of the present invention is to provide a color diffusion transfer film unit which contains a photographically useful substance in a stable state.

Another object of the present invention is to provide a color diffusion transfer film unit which provides a clear and high quality image at a high rate of image formation.

The above objects of the present invention are accomplished by the following color diffusion transfer film units (1) to (6):

(1) A color diffusion transfer film unit containing an alkali processing element as one of the elements constituting the film unit, in which at least one of the elements contains at least one oligomer or polymer having surface activity.

(2) A color diffusion transfer film unit according to (1) above, in which at least one of the elements contains a white or black pigment and at least one oligomer or polymer having surface activity.

(3) A color diffusion transfer film unit according to (1) above, in which at least one of the elements contains a dye image-forming substance and at least one oligomer or polymer having surface activity.

(4) A color diffusion transfer film unit according to (1) above, in which at least one of the elements contains a tertiary amine polymer and at least one oligomer or polymer having surface activity.

(5) A color diffusion transfer film unit according to (4) above, in which the element containing a tertiary amine polymer and at least one oligomer or polymer having surface activity is an alkali processing element.

(6) A color diffusion transfer film unit according to (1) above, in which the oligomer or polymer having surface activity is incorporated in a light-sensitive element, a neutralization timing element or an image-receiving element.

(7) A color diffusion transfer film unit according to (1) above, in which the oligomer or polymer having surface activity is incorporated in the alkali processing element.

(8) A color diffusion transfer film unit according to any one of (1) to (7), in which the oligomer or polymer having surface activity is a hydrophilic oligomer or polymer comprising at least two groups selected from a hydrophobic group, a hydrophilic nonionic functional group, and an anionic functional group or a salt thereof.

DETAILED DESCRIPTION OF THE INVENTION

The oligomer or polymer having surface activity (hereinafter simply referred to as "the oligomer or polymer") is a so-called high polymeric surface active agent composed of a hydrophilic oligomer or polymer having, in the molecular structure thereof, at least two groups selected from the groups of a hydrophobic group, a hydrophilic nonionic functional group, and an anionic functional group or a salt thereof. High polymeric surface active agents are known to be generally superior to classical low-molecular weight surface active agents in ability to improve dispersion stability and are widely employed in pigment or cement dispersions.

Noting the effects of high polymeric surface active agents, the present inventors have conducted extensive investigations into the effect of the above-mentioned oligomer or polymer on stabilization of a tertiary amine polymer latex. As a result, they have found that the oligomer or polymer is effective and that the effect is especially noticeable where a tertiary amine polymer latex is used in an alkali processing solution. They have further studied application of the oligomer or polymer to a color diffusion transfer system using gelatin as a binder and ascertained that the oligomer or polymer improves dispersion stability of not only the tertiary amine polymer but other photographically useful substances generally used in the color diffusion transfer system and that, in addition, the oligomer or polymer not only improves preservation stability of these dispersions but accelerates image formation. These effects are more than what would be obtained from general stabilization of dispersions, and the use of the oligomer or polymer will make it possible to reduce the amounts of photographically useful substances, which leads to reduction in film thickness.

For example, the oligomer or polymer according to the present invention is effective when used in combination with a pigment or a dye image-forming substance. The pigments usually used in a color diffusion transfer film unit include a white pigment, mainly titanium dioxide, which is used, e.g., in a white reflecting layer, and a black pigment, mainly carbon black, which is used, e.g., in a light-shielding layer. Different dye image-forming substances are separately used in a blue-sensitive emulsion layer, a green-sensitive emulsion layer, and a red-sensitive emulsion layer. Addition of the oligomer or polymer to each of these layers brings about improvement of dispersibility in the respective layer.

Where the oligomer or polymer is used in an alkali processing component (solution) in combination with a tertiary amine polymer, the oligomer or polymer is incorporated according to the following procedure.

(1) Emulsion polymerization for obtaining a tertiary amine polymer is conducted in the presence of at least one of a low-molecular weight surface active agent and the oligomer or polymer of the present invention. Preferably, the emulsion polymerization of the tertiary amine is carried out in the presence of at least one of the oligomers or polymers of the present invention. In order to enhance stability of the resulting polymer latex, it is preferable to add to the polymer at least one of a low-molecular weight surface active agent and the oligomer or polymer, which may be the same as or different from that used in the emulsion polymerization. Still preferably, a polymerizable surface active agent (so-called surfmer) is used as part of a polymerizing system. In this case, emulsion polymerization is preferably carried out while adding the surfmer dropwise to the system.

(2) Then, an alkali processing solution is prepared using the tertiary amine polymer latex obtained above either as such or in combination with at least one of additional low-molecular weight surface active agent and additional oligomer or polymer, which may be the same as or different from that used in the emulsion polymerization. The latter combined addition is preferred. Thus, a stable latex having a small and uniform particle size can be obtained, and the processing components exhibit markedly improved dispersion stability in the processing composition. At the same time, an undesired increase in image density after image formation is significantly suppressed.

The low-molecular weight surface active agents which can be used in the present invention are ordinary ones commonly known in the art and include, for example, nonionic surface active agents and anionic surface active agents. Examples of useful compounds are given, e.g., in Fujimoto Takehiko, *Shin-Kaimenkasseizai Nyumon,* Sanyo Chemical Industries, Ltd.

As stated above, while the oligomer or polymer of the present invention may not be used in emulsion polymerization for preparing a tertiary amine polymer latex, it is preferable to conduct the polymerization using the oligomer or polymer. Likewise, the addition of the oligomer or polymer to the resulting tertiary amine polymer latex for particle size stabilization is preferred, while not essential. In this way, use of the resulting tertiary amine polymer latex as one of the components of an alkali processing solution simultaneously means addition of the oligomer or polymer.

In a particularly preferred embodiment of the present invention, a tertiary amine polymer latex is synthesized by emulsion polymerization in the presence of the oligomer or polymer, the oligomer or polymer is added to the resulting latex for particle size stabilization, and the oligomer or polymer is again used in the preparation of an alkali processing solution. That is, there are three occasions at which the oligomer or polymer may be added. The oligomers or polymers to be added on two or three occasions may be all the same, partly the same, or all different.

The oligomer or polymer according to the present invention is a hydrophilic oligomer or polymer included under the category of so-called high polymeric surface active agents in the broad sense, and has, in the molecular structure thereof, at least two of a hydrophobic group, a hydrophilic nonionic functional group, and an anionic functional group or a salt thereof. An effective weight average molecular weight of the oligomer or polymer is $1\times10^3$ to $1\times10^6$. Compounds having higher molecular weight conversely act as a high polymeric coagulant. An especially preferred molecular weight is $1\times10^3$ to $5\times10^3$.

The oligomers or polymers effective in the present invention may be either nonionic or anionic. In particular, anionic oligomers or polymers are preferred. In using a nonionic oligomer or polymer, additional use of a low-molecular weight anionic surface active agent brings about further improvement in dispersion stability as mentioned above. Note that a classical low-molecular weight anionic surface active agent alone fails to achieve dispersion stabilization.

The oligomer or polymer having surface activity can be synthesized in a conventional manner. Typical examples of synthesis are described below for illustration but not for limitation.

(1) Method consisting of radical or ionic polymerization of an ethylenically unsaturated monomer or macromonomer comprising at least two groups selected from a hydrophobic group, a hydrophilic nonionic functional group, and an anionic functional group or a salt thereof.

Oligomers or polymers obtained by method (1) may have any primary structure selected from a random copolymer, a block copolymer and a graft copolymer. A block or graft copolymer is preferred.

With respect to random copolymerization, refer to JP-A-1-263103 and JP-A-6-48348 (the term "JP-A" as used herein means an "unexamined published Japanese patent application"). Where living polymerization is possible in ionic polymerization, an amphiphilic oligomer or polymer of block copolymer type, which is favorable in the present invention, can be obtained by successive addition of another monomer. An example of block copolymerization utilizing a living polymer is disclosed in JP-A-63-147533. In the case of radical polymerization, too, a similar block copolymer type oligomer or polymer can be synthesized by using a thiol-terminated oligomer or polymer. For the details, refer to JP-A-60-240763.

In using a macromonomer, a grafted oligomer or polymer, which is also favorable in the present invention, can be obtained. Synthesis of macromonomers and synthesis of oligomers or polymers using macromonomers are described, e.g., in Yamashita Yuya (ed.), *Macromonomer no Kagaku to Kogyo,* I.P.C. (1989). Preferred oligomers or polymers can also be synthesized by using an amino acid or an oxazoline derivative.

(2) Method of using a hydrocarbon which exhibits hydrophobic properties sufficient for manifestation of surface activity and has a reactive group at one terminal thereof as an initiator, a chain transfer agent or a terminator of polymerization (radical or ionic polymerization or polycondensation) or as a reactant of a high polymer reaction (mainly reaction with a hydrophilic high polymer).

Polyamino acid or polyoxazoline prepared by using a long-chain alkyl-terminated amino group as an initiator, and radical copolymers prepared by using a long-chain alkyl-terminated thiol as a chain transfer agent may be mentioned as examples. The desired oligomer or polymer can be obtained by appropriately selecting an amino acid, oxazoline or a derivative thereof and conducting a subsequent reaction such as hydrolysis. For the details of method (2), reference can be made to the processes described in Saegusa Takeo, *Kaikan Jugo (I), (II),* Kagaku Dojin (1971) and J. R. J. *Selesa, Block and Graft Polymerization,* John Wiley & Sons (1973).

In particular, radical copolymers using a long-chain alkyl-terminated thiol as a chain transfer agent, the synthesis of which is disclosed in JP-A-61-254237, show noticeable effects on dispersion stability of an alkali processing solution of the present invention, as have been used as a dispersion stabilizer for suspension polymerization of a vinyl compound as described in JP-A-59-166505 and JP-A-63-171628.

(3) Addition polymerization:

A series of compounds called Pluronic may be mentioned as examples of high polymeric surface active agents obtained by successive addition polymerization. A stable alkali processing solution can be obtained by appropriate selection of a polypropylene oxide to polyethylene oxide ratio and a molecular weight of the polymer. The compound is characterized by its great defoaming effect as a secondary effect. Preferred oligomers or polymers of the present invention can also be synthesized by subjecting the addition polymer to a subsequent reaction.

The hydrophobic groups which can be used in the oligomer or polymer preferably include a repeating unit forming a polymer which is derived from a hydrophobic ethylenically unsaturated monomer, a hydrophobic amino acid and its derivative, or a hydrophobic oxazoline or oxazine derivative, a repeating unit forming a polymer which is derived from an alkylene oxide group having 3 carbon atoms of propyleneoxide, or more carbon atoms in the alkyl moiety thereof, and a hydrocarbon group having a reactive group at one terminal thereof, which does not form a polymer.

The hydrophobic ethylenically unsaturated monomer includes a vinylketone, an alkyl vinyl ester or ether, styrene, an alkylstyrene, a halostyrene, acrylonitrile, butadiene, isoprene, chloroprene, ethylene, an alkyl-substituted ethylene, a haloethylene, and a halogenated vinylidene. Specific examples of the hydrophobic monomers are described in *Research Disclosure* No. 19551, p. 301 (July, 1980).

Preferred but non-limiting examples of the repeating unit derived from a hydrophobic amino acid or its derivative, a hydrophobic oxazoline or oxazine derivative are shown below:

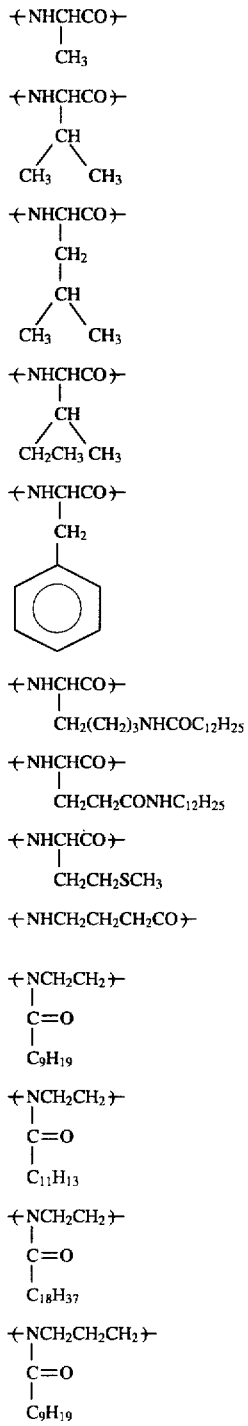

-continued

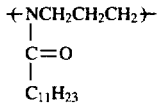

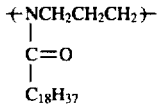

The reactive group of the reactive group-terminated hydrocarbon group preferably includes a carboxyl group, a sulfonic acid group, a phosphoric acid group, an amino group, a hydroxyl group, and a thiol group. Hydrophobic groups other than the reactive group include aliphatic hydrocarbon groups (e.g., alkyl, alkenyl and alkynyl) and aromatic hydrocarbon groups (e.g., phenyl and naphthyl), each of which may have a substituent(s) selected from an aliphatic group, an aromatic group, an alicyclic group, a heterocyclic group, a halogen atom, a hydroxyl group, a cyano group, a nitro group, an N-substituted sulfamoyl group, a carbamoyl group, an acylamino group, an alkylsulfonylamino group, an arylsulfonylamino group, an alkoxy group, an aryloxy group, an aralkyl group, an acyl group, etc. Aliphatic hydrocarbon groups and aromatic hydrocarbon groups are preferred of these groups. Substituted or unsubstituted aliphatic hydrocarbons having 2 to 50, particularly 8 to 24, carbon atoms in total and substituted or unsubstituted aromatic hydrocarbon groups having 8 to 30 carbon atoms in total are still preferred.

Preferred but non-limiting examples of the hydrophobic groups other than the reactive group are shown below.

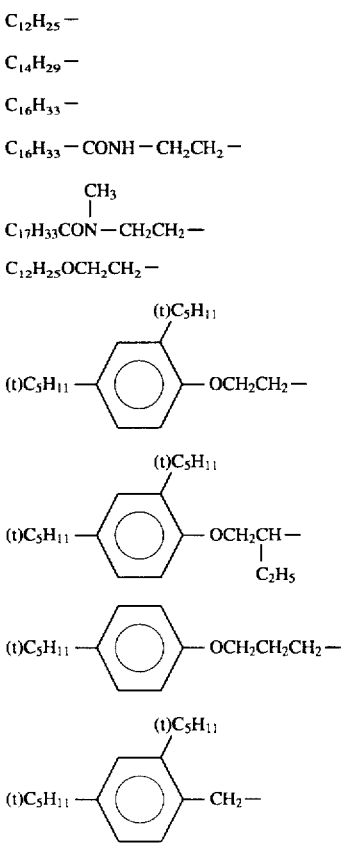

-continued

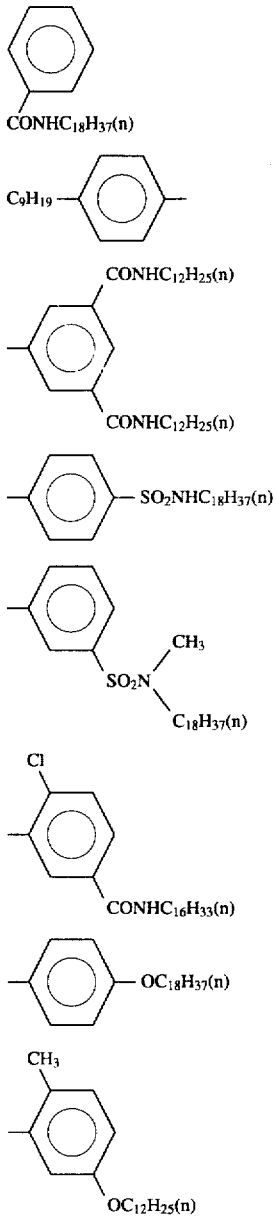

The hydrophilic nonionic functional group which constitutes the oligomer or polymer of the present invention preferably includes a repeating unit derived from an ethylenically unsaturated monomer having an ether group, an ethylene oxide group, a hydroxyl group or an amido group as a functional group in the molecular structure thereof and a repeating unit consisting of the above-described functional group per se, such as a repeating unit derived from ethylene oxide, ring-opened oxazoline or a derivative thereof.

Preferred but non-limiting examples of the hydrophilic nonionic groups are shown below:

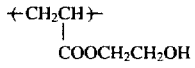

-continued

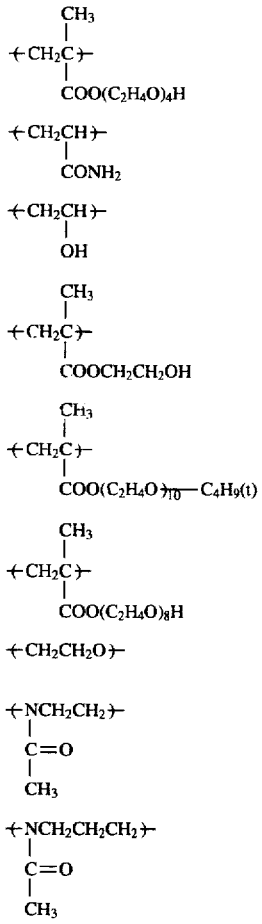

The anionic functional group preferably includes a repeating unit derived from an ethylenically unsaturated monomer containing a sulfonic acid group or a salt thereof, a carboxyl group or a salt thereof or a phosphoric acid group or a salt thereof as a functional group in the molecular structure thereof and a repeating unit derived from an amino acid or a derivative thereof having the above-mentioned functional group. The above-mentioned functional group may be introduced through a high polymeric reaction.

Preferred but non-limiting examples of the anionic functional group are shown below:

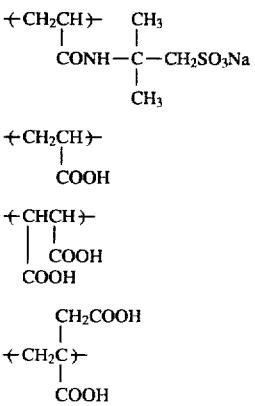

-continued

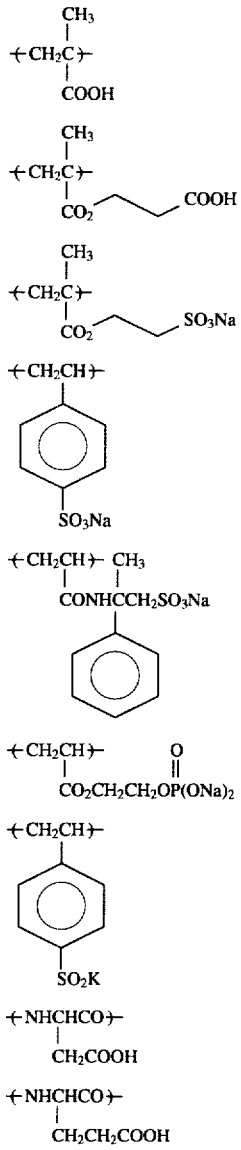

Specific examples of the oligomer or polymer which can preferably be used in the present invention are shown below for illustrative purposes but not for limitation. The compounds, synthesized by method (1) or (2), are listed in the order of [I] random copolymers, [II] block copolymers, [III] graft copolymers, and [IV] terminal group reaction type copolymers and others. In each oligomer or polymer, while the monomer ratio and molecular weight for manifestation of surface activity have breadth and are hardly specified, the optimum monomer ratio and molecular weight can be decided according to the dispersion to which the oligomer or polymer is applied. In formulae shown, symbol M represents a hydrogen atom, an alkali metal, e.g., Na or K, or ammonium; and symbols b and g stand for a block copolymer and a graft copolymer, respectively. The number in the main chain represents a molar ratio of the monomer; and m and n each represent an average degree of polymerization.

I. Random Copolymers:
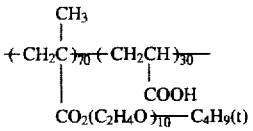
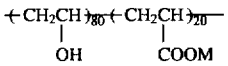
P-1
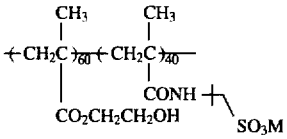
P-2
P-3
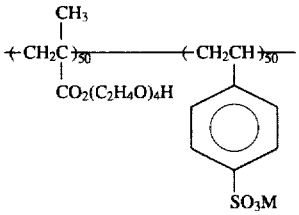
P-4
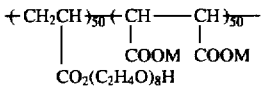
P-5
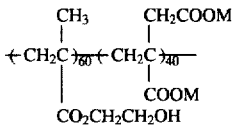
P-6
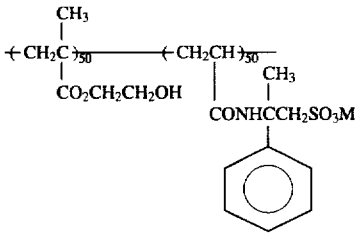
P-7
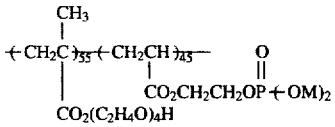
P-8
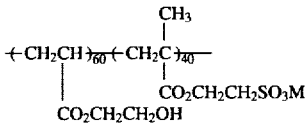
P-9
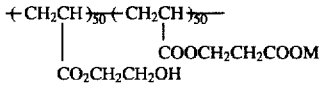
P-10
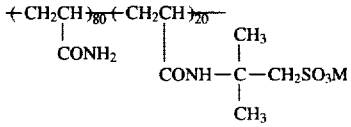
P-11
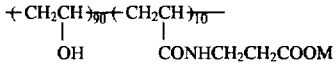
P-12
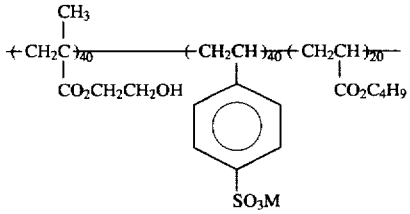
P-13
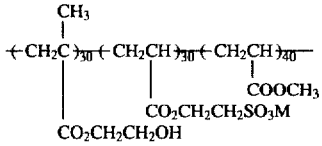
P-14
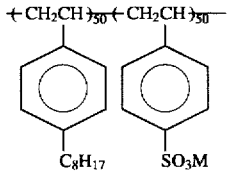
P-15
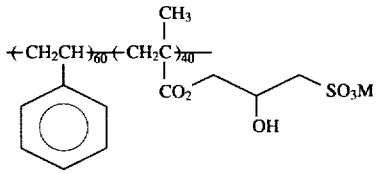
P-16

-continued
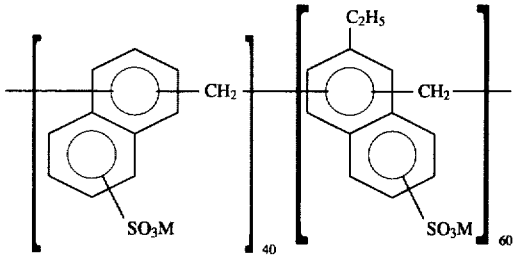
P-17
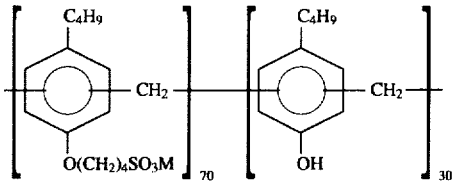
P-18
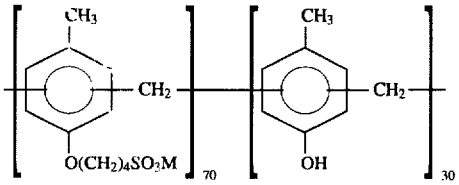
P-19
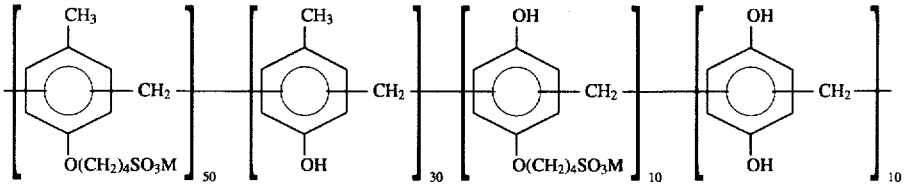
P-20
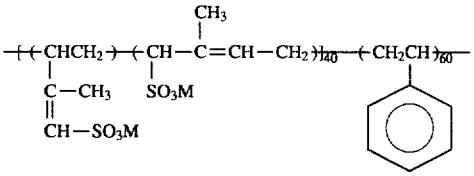
P-21
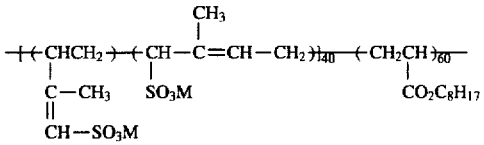
P-22
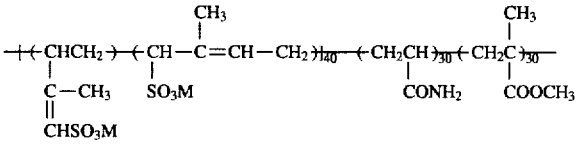
P-23
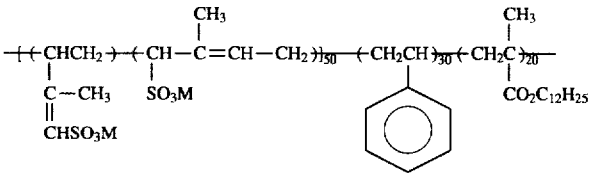
P-24
II. Block Copolymers:
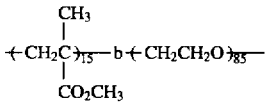
P-25
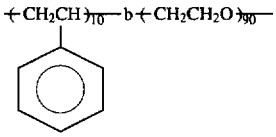
P-26
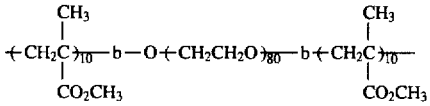
P-27
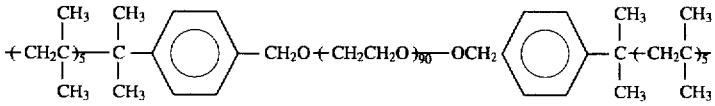
P-28
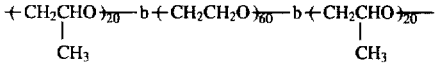
P-29

-continued
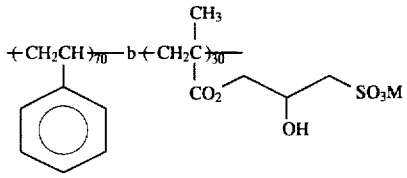
P-30
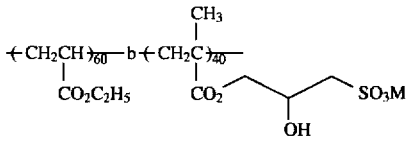
P-31
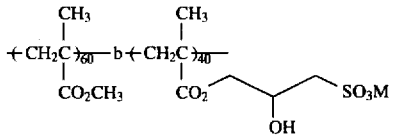
P-32
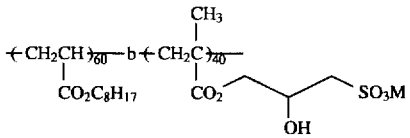
P-33
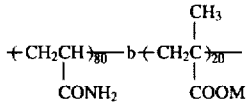
P-34
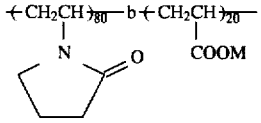
P-35
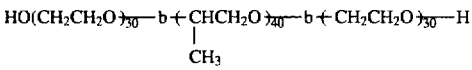
P-36
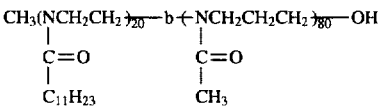
P-37
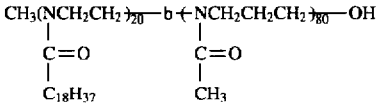
P-38
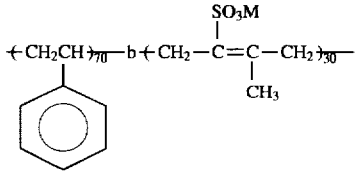
P-39
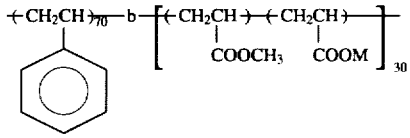
P-40
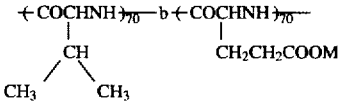
P-41
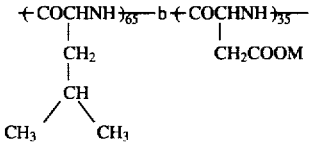
P-42
III. Graft Copolymers:
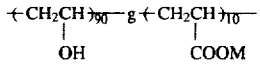
P-43
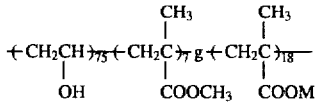
P-44
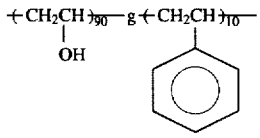
P-45
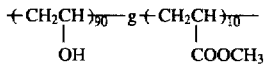
P-46
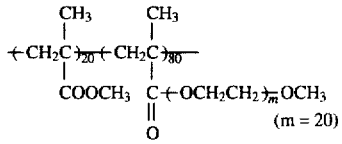
P-47
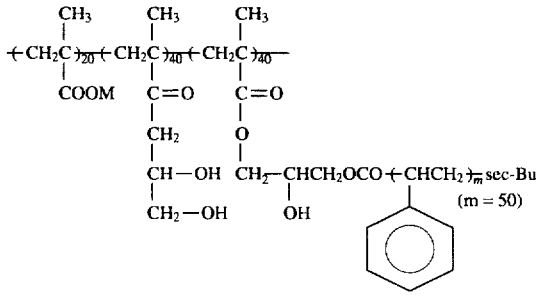
P-48

-continued
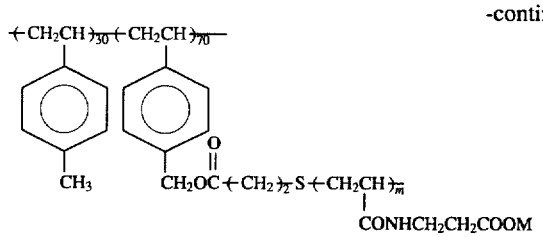
P-49
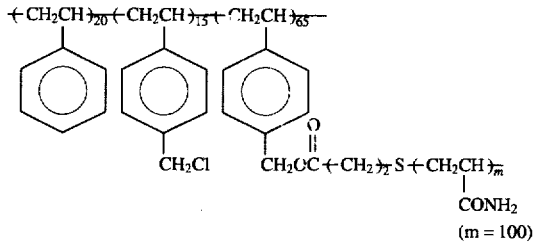
(P-50)
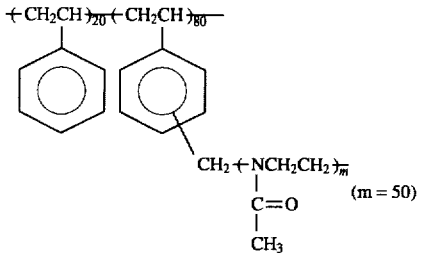
P-51
IV. Terminal Group Reaction Type and Others:
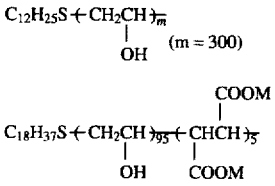
P-52 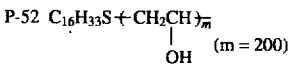
P-53
P-54 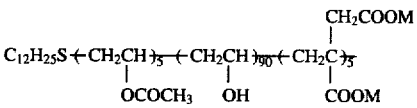
P-55
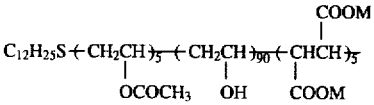
P-56 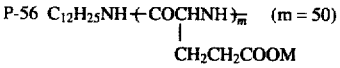
P-57
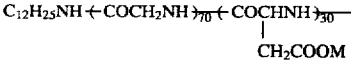
P-58 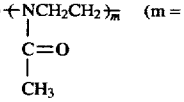
P-59
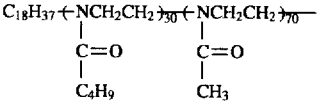
P-60 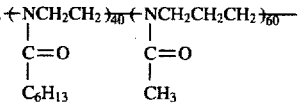
P-61
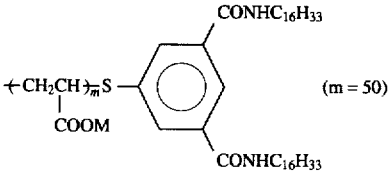
P-62

-continued

P-63

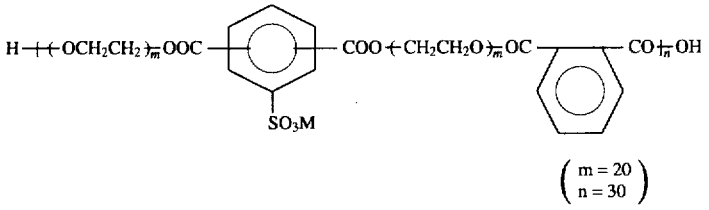

P-64

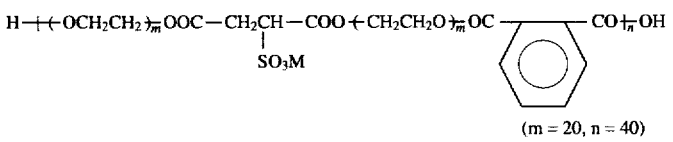

P-65

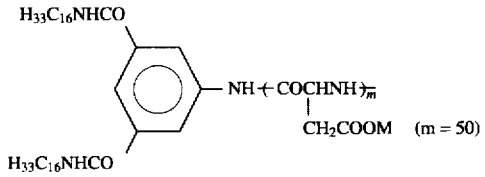

Among these oligomers and polymers preferred are block type, graft type, and terminal group reaction type oligomers and polymers, and still preferred are block type and terminal group reaction type oligomers and polymers. Of the block type, those composed of a hydrophobic monomer unit and an anionic monomer unit are particularly preferred. Of the terminal group reaction type, a polyvinyl alcohol derivative having a hydrophobic terminal (called terminal modified PVA) and oxazoline or oxazine derivative having a hydrophobic terminal are particularly preferred.

Photographically useful substances which are advantageously combined with the oligomer or polymer include black or white pigments, such as carbon black and titan white; dye image-forming substances (dye-releasing compounds) such as dye precursors; color mixing inhibitors such as hydroquinone derivatives; oil-soluble organic compounds such as UV absorbents and discoloration inhibitors; and tertiary amine polymers. Particularly appreciable effects are observed when the oligomer or polymer is combined with black or white pigments, dye image-forming substances, or tertiary amine polymers.

Useful white pigments include barium sulfate, zinc oxide, barium stearate, silver flakes, various silicates, alumina, zirconium oxide, sodium zirconium sulfate, kaolin, mica, titanium dioxide, and non-film-forming polymer particles such as polystyrene. Titanium dioxide is particularly preferred.

Carbon black is a preferred black pigment. The process for preparing carbon black is not limited.

Where the oligomer or polymer is used in a pigment-containing layer, it is used in an amount of from 0.01 to 20% by weight, preferably from 0.02 to 15% by weight, still preferably from 0.05 to 10% by weight, based on the pigment.

Other photographically useful substances which are combined with the oligomer or polymer having surface activity are color image-forming substances and compounds used for color mixing prevention, which are mentioned below in greater detail.

(1) Dye image forming substance (Dye-releasing compound):

The dye image-forming substances (dye-releasing compounds) which can be used in the present invention are nondiffusion compounds capable of releasing a diffusing dye or a precursor thereof upon silver development or compounds capable of changing their diffusibility upon silver development. These dye image-forming substances are described in *The Theory of the Photographic Process*, the 4th Ed. They are all represented by formula (III):

$$(\text{DYE-Y})_n\text{—Z} \qquad \text{(III)}$$

wherein DYE represents a dye group, a dye group temporarily shifted to a short wavelength, or a dye precursor group thereof; Y represents a mere single bond or a linking group; Z represents a group which, either correspondingly or inverse-correspondingly to a light-sensitive silver salt forming a latent image, changes the diffusibility of the compound represented by $(\text{DYE-Y})_n$—Z or releases DYE to produce a difference in diffusibility between the released DYE and $(\text{DYE-Y})_n$—Z; and n represents 1 or 2; when n is 2, two groups of (DYE-Y) may be the same or different.

The dye image-forming compounds of formula (III) are divided into negatively working compounds which become diffusible in a silver developed area and positively working compounds which become diffusible in an undeveloped area according to the function of the group Z.

The negative type Z includes groups which are oxidized and split as a result of silver development to release a diffusing dye. Specific examples of the negative type Z are described in U.S. Pat. Nos. 3,928,312, 3,993,638, 4,076,529, 4,152,153, 4,055,428, 4,053,312, 4,198,235, 4,179,291, 4,149,892, 3,844,785, 3,443,943, 3,751,406, 3,443,939, 3,443,940, 3,628,952, 3,980,479, 4,183,753, 4,142,891, 4,278,750, 4,139,379, 4,218,368, 3,421,964, 4,199,355, 4,199,354, 4,135,929, 4,336,322, and 4,139,389, JP-A-53-50736, JP-A-51-104343, JP-A-54-130122, JP-A-53-110827, JP-A-56-12642, JP-A-56-16131, JP-A-57-4043, JP-A-57-650, JP-A-57-20735, JP-A-53-69033, JP-A-54-130927, JP-A-56 -164342, and JP-A-57-119345.

Of the negative Z groups of negatively dye-releasing redox compounds, an N-substituted sulfamoyl group (the N-substituent including a group derived from an aromatic hydrocarbon ring or a heterocyclic ring) is preferred. Illustrative examples of Z are shown below, but not limited thereto.

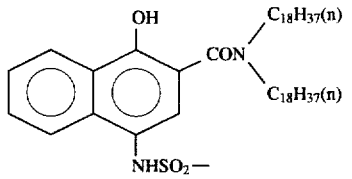

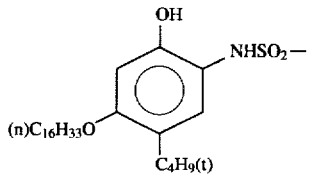

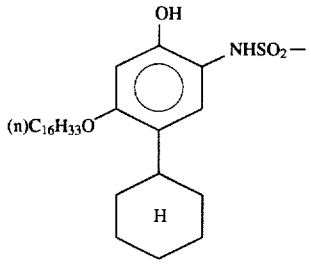

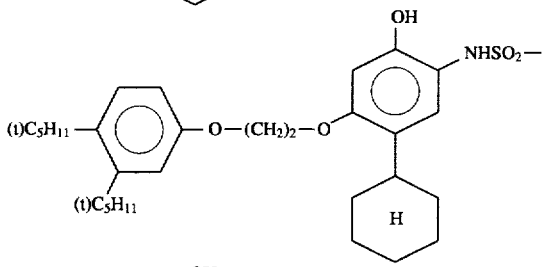

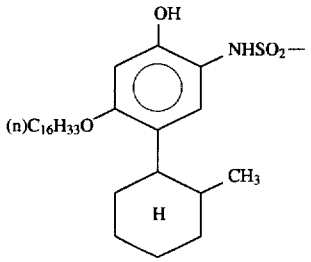

Positively working compounds are described in *Angev. Chem. Inst. Ed. Engl.*, Vol. 22, p. 191 (1982).

Compounds called dye developers which are diffusible in the initial alkaline condition but becomes non-diffusible on being oxidized by development can be mentioned as examples of this type of compounds. Typical examples of positive type Z groups useful for this type of compounds are given in U.S. Pat. No. 2,983,606.

Another type is compounds which release a diffusing dye through, for example, self-cyclization under an alkaline condition but substantially stop dye release on being oxidized by development. Specific examples of Z having such a function are described in U.S. Pat. No. 3,980,479, JP-A-53-69033, JP-A-54-130927, and U.S. Pat. Nos. 3,421,964 and 4,199,355.

Still another type is compounds which do not release a dye by themselves but release a dye on being reduced. Compounds of this type are used in combination with an electron donor and react with a residual electron donor after imagewise oxidization by silver development to release a diffusing dye imagewise. Specific examples of Z having such a function are described, e.g., in U.S. Pat. Nos. 4,183,753, 4,142,891, 4,278,750, 4,139,379, and 4,218,368, JP-A-53-110827, U.S. Pat. Nos. 4,278,750, 4,356,249, and 4,358,525, JP-A-53-110827, JP-A-54-130927, JP-A-56-164342, Technical Disclosure Bulletin 87-6199, and EP-A2-220746. Illustrative examples of these groups are shown below.

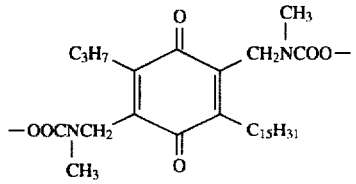

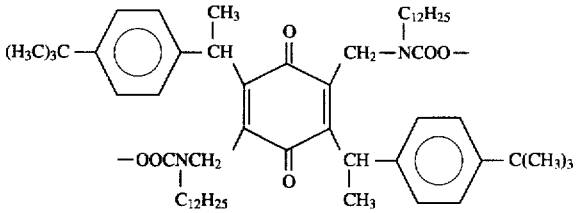

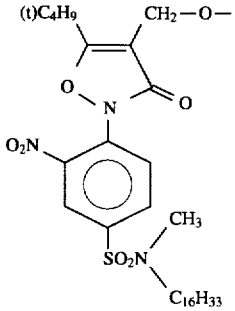

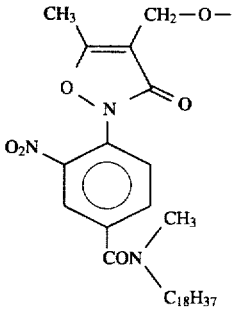

In using the compound of this type, it is preferably combined with a nondiffusible electron-donating compound known as an ED compound or a precursor thereof. Examples of the ED compound are described in U.S. Pat. Nos. 4,263,393 and 4,278,750 and JP-A-56-138736.

Additionally the following compounds are also useful as a dye image-forming substance.

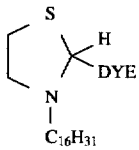

-continued

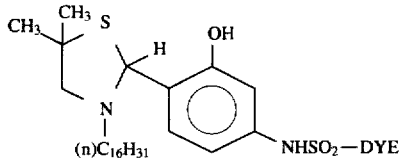

wherein DYE has the same meaning as defined in formula (III).

The details of these compounds are described in U.S. Pat. Nos. 3,719,489 and 4,098,783.

Specific examples of the dyes derived from the dye groups or dye precursor groups represented by DYE in the foregoing formulae are described in the following publications:

Yellow Dyes:

U.S. Pat. Nos. 3,597,200, 3,309,199, 4,013,633, 4,245,028, 4,156,609, 4,139,383, 4,195,992, 4,148,641, 4,148,643, and 4,336,322, JP-A-51-114930, JP-A-56-71072, *Research Disclosure* 17630 (1978), and ibid 16475 (1977).

Magenta Dyes:

U.S. Pat. Nos. 3,453,107, 3,544,545, 3,932,380, 3,931,144, 3,932,308, 3,954,476, 4,233,237, 4,255,509, 4,250,246, 4,142,891, 4,207,104, and 4,287,292, JP-A-52-106727, JP-A-53-23628, JP-A-55-36804, JP-A-56-73057, JP-A-56-71060, and JP-A-55-134.

Cyan Dyes:

U.S. Pat. Nos. 3,482,972, 3,929,760, 4,013,635, 4,268,625, 4,171,220, 4,242,435, 4,142,891, 4,195,994, 4,147,544, and 4,148,642, British Patent 1,551,138, JP-A-54-99431, JP-A-52-8827, JP-A-53-47823, JP-A-53-143323, JP-A-54-99431, JP-A-56-71061, European Patents 53,037 and 53,040, *Research Disclosure* 17630 (1978), and ibid 16475 (1977).

These dye image-forming compounds can be dispersed according to the methods described in JP-A-62-215272, pp. 144–146. The dispersion of the dye image-forming compound may contain the compounds described in JP-A-62-215272, pp. 137–144.

(2) Color mixing inhibiting agent:

The intermediate layer preferably contains a nondiffusible reducing agent so as to prevent diffusion of an oxidation product of the developing agent. Such a nondiffusible reducing agent includes non-diffusible hydroquinone, sulfonamidophenol and sulfonamidonaphthol. Specific examples are described in JP-A-50-21249, JP-A-50-23813, JP-A-49-106329, JP-A-49-129535, U.S. Pat. Nos. 2,336,327, 2,360,290, 2,403,721, 2,544,640, 2,732,300, 2,782,659, 2,937,086, 3,637,393, and 3,700,453, British Patent 557,750, JP-A-57-24941, and JP-A-58-21249.

Methods for preparing dispersions of the compounds of (1) and (2) disclosed above are described in JP-A-60-238831 and JP-B-60-18978.

The tertiary amine polymer, a photographically useful substance to be combined with the oligomer or polymer of the present invention, comprises a repeating unit represented by formula (I):

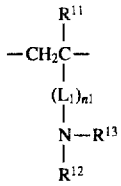

(I)

wherein $R^{11}$ represents a hydrogen atom or an alkyl group preferably having 1 to 20 carbon atoms; $R^{12}$ and $R^{13}$ each represent an alkyl group preferably having 1 to 20 carbon atoms, an aralkyl group preferably having 1 to 20 carbon atoms, an alkenyl group preferably having 1to 20 carbon atoms or an alkynyl group preferably having 1 to 20 carbon atoms; $L_1$ represents a divalent linking group; $n_1$ represents 0 or 1; and $R^{12}$, $R^{13}$, and $L_1$ may be taken together to form a ring.

In more detail, $R^{11}$ represents a hydrogen atom or an alkyl group having 1 to 4 carbon atoms, and preferably a hydrogen atom or a methyl group.

$R^{12}$ and $R^{13}$ each independently represent an alkyl group having 1 to 20 carbon atoms (e.g., methyl, ethyl, n-butyl, 2-ethylhexyl, dodecyl or cyclohexyl), an aralkyl group (e.g., benzyl or phenethyl), an alkenyl group preferably having 1 to 20 carbon atoms (e.g., allyl) or an alkynyl group preferably having 1 to 20 carbon atoms (e.g., propargyl), and preferably an alkyl group.

$R^{12}$, $R^{13}$, and $L_1$ may be connected to each other to form a 3- to 8-membered ring, preferably a 5- or 6-membered ring.

$L_1$ represents a divalent linking group having 1 to 24 carbon atom in total and includes an alkylene group (e.g., methylene, ethylene, propylene or butylene), an arylene group preferably having 6 to 24 carbon atoms (e.g., phenylene or naphthylene), an ether group, an amido group, an ester group, a thio group, a thioether group, or a group composed of two or more of the above-mentioned linking groups connected in series (e.g., phenylenemethylene, xylylene, phenyleneoxy, phenylenethio, carboxyethylene, carbonylaminopropylene, carbonylaminobutylene or phenylenemethyleneoxyhexylene).

Among these linking groups preferred are those having an alkylene moiety which is directly bonded to the nitrogen atom of the tertiary amine. Examples of such groups are an alkylene group, and a carboxyalkylene group, a caboxyaminoalkylene group or a phenylenemethyloxyalkylene group with the methylene moiety side thereof bonded to the nitrogen atom.

$n_1$ is 0 or 1, preferably 1.

$R^{11}$, $R^{12}$, $R^{13}$, and $L_1$ may have a substituent. Suitable substituents include a hydroxyl group, an alkoxy group preferably having 1 to 20 carbon atoms (e.g., methoxy or ethoxy), an aryloxy group preferably having 6 to 20 carbon atoms (e.g., phenoxy), an amino group, an alkylamino group preferably having 1 to 20 carbon atoms, a carbamoyl group, a sulfamoyl group, a cyano group, and a halogen atom. When the substituent is introduced, a negative atom, such as oxygen, nitrogen or sulfur, is preferably apart from the nitrogen atom of the tertiary amine, i.e., is not preferably bonded to the carbon atom at the α- or β-position from the nitrogen atom of the tertiary amine.

The tertiary amine polymer may further comprise other repeating unit(s) derived from other vinyl monomers in addition to the repeating unit of formula (I). Examples of useful vinyl monomers include monofunctional monomers such as styrene, α-methylstyrene, p-methylstyrene, p-t-butylstyrene, m-ethylstyrene, chlorostyrene, propylene, 1-butene, isobutene, vinyl acetate, acrylic acid and its esters, methacrylic acid and its esters, acrylamide, methacrylamide, acrylonitrile, methacrylonitrile, N-vinylpyrrolidone, butadiene, vinylbenzyl alcohol, styrenesulfinic acid salts, and styrenesulfonic acid salts; and bifunctional monomers such as divinylbenzene, ethylene glycol dimethacrylate, isopropylene glycol diacrylate, and tetramethylene glycol dimethacrylate.

The tertiary amine polymer is preferably a latex polymer having a crosslinked structure with, e.g., divinylbenzene.

The tertiary amine polymer may contain, in the molecule thereof, an anionic group, such as a carboxyl group, a sulfonic acid group, a sulfinic acid group or a phenolic hydroxyl group, with a carboxyl group being preferred. Preferred repeating units containing such an anionic group are represented by formula (II):

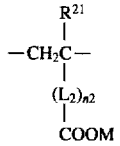

(II)

wherein $R^{21}$ represents a hydrogen atom or an alkyl group; $L_2$ represents a divalent linking group; $n_2$ represents 0 or 1; and M represents a hydrogen atom or an alkali metal atom.

More specifically, $R^{21}$ represents a hydrogen atom or an alkyl group having 1 to 4 carbon atoms, preferably a hydrogen atom or a methyl group. $L_2$ has the same meaning as $L_1$ of formula (I) and preferably represents an alkylene or arylene group of —CONH— or —COO—. $n_2$ is preferably 1. M is preferably a hydrogen atom or a potassium atom.

A latex polymer having the repeating unit of formula (I) is a preferred tertiary amine polymer to be used in the present invention.

Specific examples of the tertiary amine latex polymer which can be used in the present invention are shown below for illustrative purposes but not for limitation.

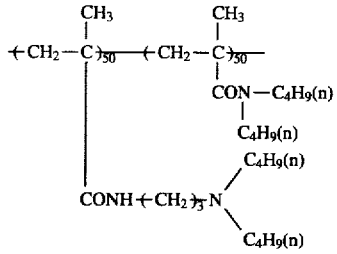

(M-1)

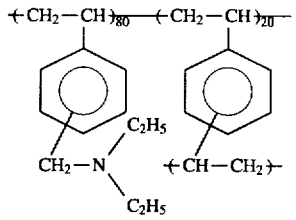

(M-2)

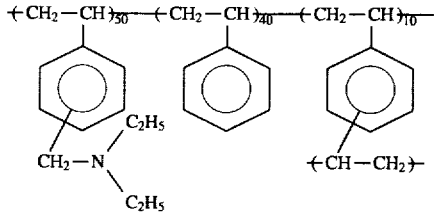

(M-3)

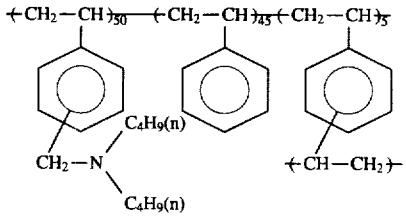

(M-4)

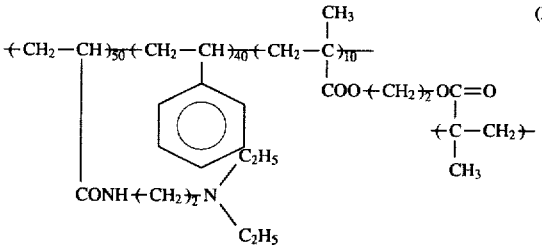

(M-5)

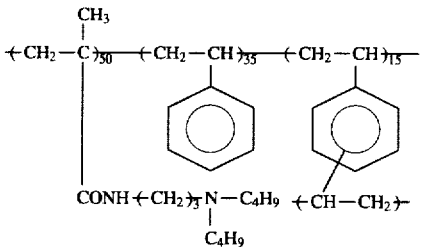

(M-6)

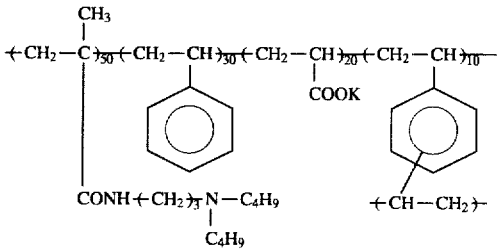

(M-7)

-continued
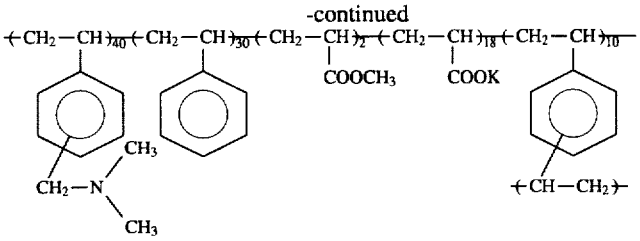
(M-8)
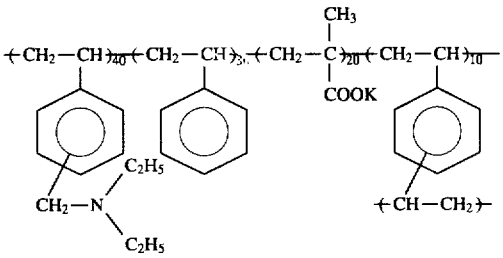
(M-9)
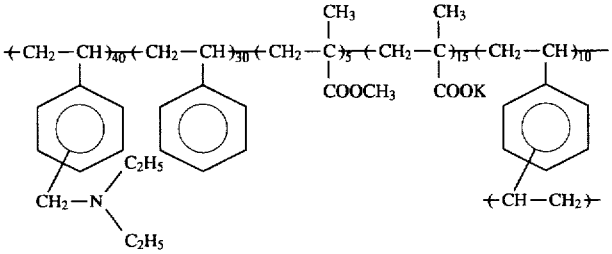
(M-10)
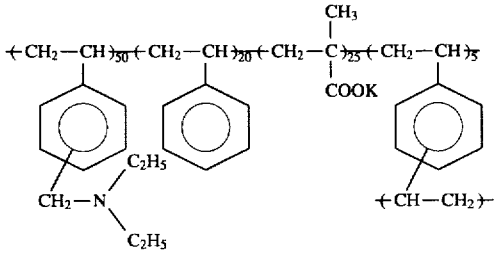
(M-11)
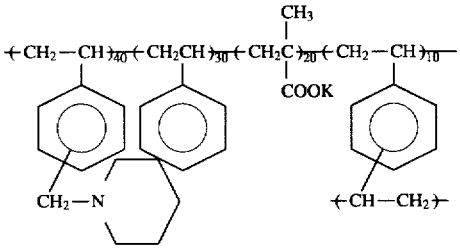
(M-12)
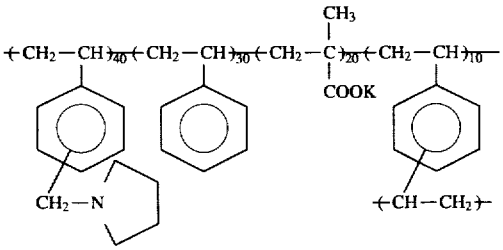
(M-13)
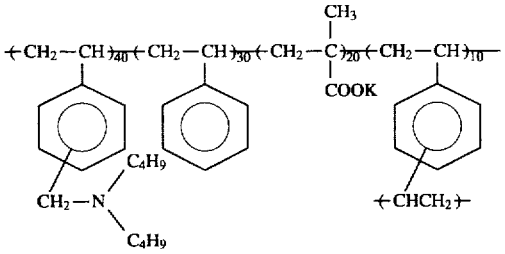
(M-14)
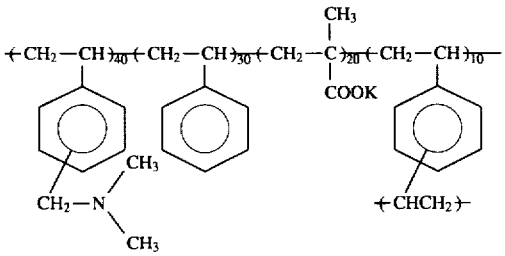
(M-15)
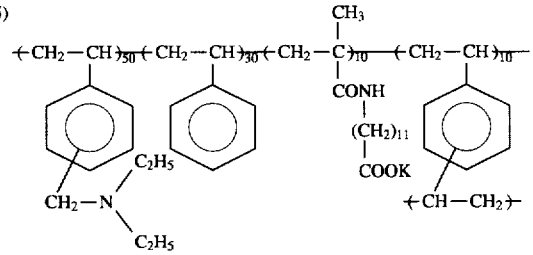
(M-16)

-continued
(M-17)
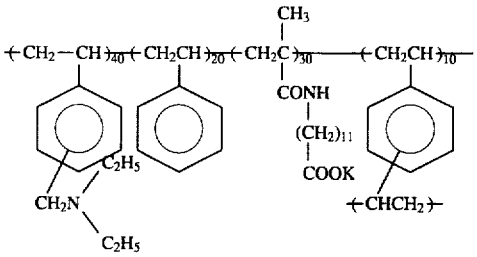
(M-18)
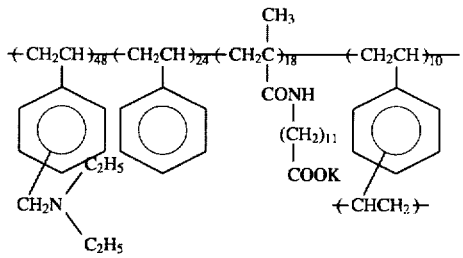
(M-19)
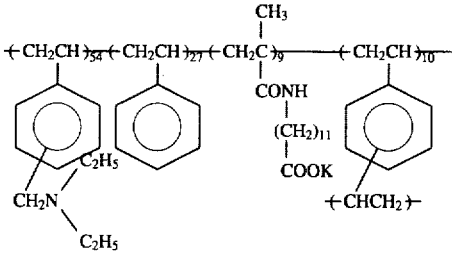
(M-20)
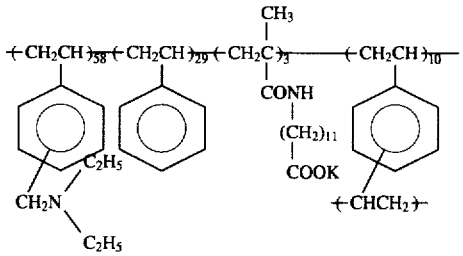
(M-21)
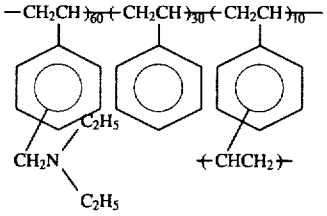
(M-22)
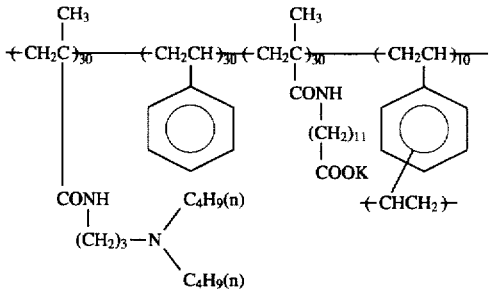
(M-23)
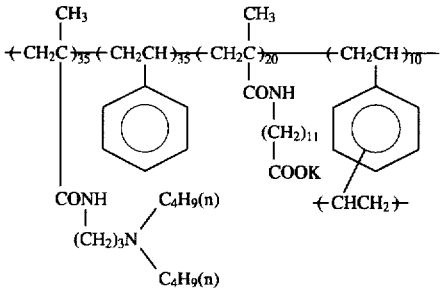
(M-24)
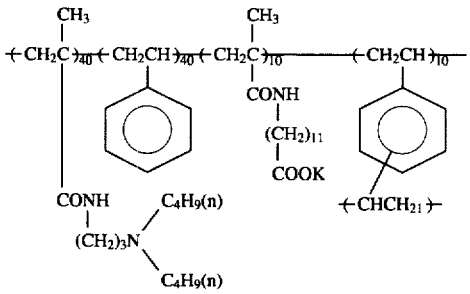
(M-25)
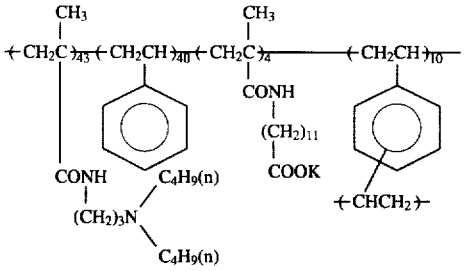
(M-26)
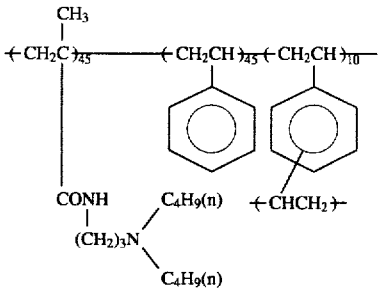
(M-27)
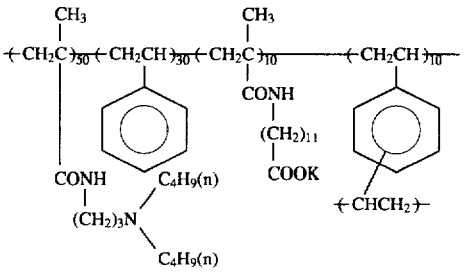
(M-28)
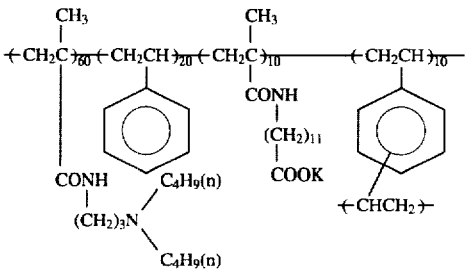

-continued

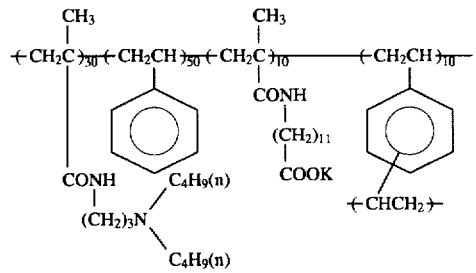

(M-29)

The tertiary amine polymer can be used in any of the elements constituting the film unit. A linear tertiary amine polymer may be added directly, or it may be dissolved in a high-boiling organic solvent and incorporated by emulsifying in a conventional manner. A latex polymer usually has a particle diameter of 10 to 1000 nm, preferably 20 to 200 nm.

The tertiary amine polymer is used in an amount of from 0.1 to 70 mmol/$m^2$, preferably from 0.2 to 50 mmol/$m^2$, still preferably from 0.3 to 20 mmol/$m^2$, in terms of the tertiary amine unit. Where it is incorporated into a processing element comprising an alkali processing solution, it is used in an amount of from 0.1 to 80 mmol, preferably from 0.2 to 50 mmol, still preferably from 0.3 to 25 mmol, per 100 g of the processing solution.

In the combination of the tertiary amine polymer and the oligomer or polymer of the present invention, the latter is used in an amount of from 1/1000 to the equivalent weight, preferably from 1/100 to ½, still preferably from 1/50 to ⅓, of the solid weight of the former.

The color diffusion transfer film units according to the present invention which can enjoy the effects of the oligomer or polymer are illustrated below.

As previously stated, color diffusion transfer film units are divided into a peel-apart type and a non-peel type. The constituent elements differ according to the type. The elements, classified according to function, include a light-sensitive element containing silver halide emulsions and dye image-forming substances, an image-receiving element which receives diffusing dyes, a processing element comprising an alkali processing solution, and a neutralization timing element. In some cases, these elements are combined to form a single element.

Specific examples of color diffusion transfer film units comprised of a plurality of elements will be shown. A non-peel type film unit is comprised of (1) a light-sensitive element comprising a transparent support having provided thereon an image-receiving layer, a white reflecting layer, a light-shielding layer, and at least one silver halide emulsion layer combined with at least one dye image-forming substance, (2) a neutralization timing element comprising a transparent support having formed thereon at least a neutralizing layer and a timing layer, and (3) a processing element comprising a light-shielding alkali processing solution, which element is ready to be spread between the light-sensitive element and the neutralization timing element.

A peel-apart type film unit is comprised of (1) an image-receiving element comprising a support having formed thereon a neutralizing layer, a timing layer, an image-receiving layer, and a release layer in this order, (2) a light-sensitive element comprising a support having a light-shielding layer having provided thereon at least one silver halide emulsion layer combined with at least one dye image-forming substance, and (3) a processing element which is to be spread between the image-receiving element and the light-sensitive element.

The above-mentioned film unit structures are no more than illustrative examples, and the film units of the present invention are not limited thereto.

The alkali processing solution, whose composition will hereinafter be described in detail in item (III) for processing solution, is packed into a destroyable container and incorporated into the film unit as a processing element. The container is destroyed and the processing solution is spread to a uniform thickness by means of a pressure roller.

The oligomer or polymer having surface activity can be incorporated into at least one of the elements constituting the film unit by an arbitrary method. While the oligomer or polymer may be used alone, it is more advantageous to use it in combination with the aforesaid photographically useful substance. The amount of the oligomer or polymer to be used is from 1/1000 to 3 times, preferably from 1/500 to the equivalent weight, still preferably from 1/200 to ½, the weight of a photographically useful substance.

When used in a light-sensitive element, a neutralization timing element or an image-receiving element, the oligomer or polymer is applied in a coating weight of 0.01 to 5 g/$m^2$, preferably 0.02 to 3 g/$m^2$. When used in a processing element, it is added in a concentration of 0.01 to 10% by weight, preferably 0.02 to 5% by weight, based on the processing solution. If the amount (or coating weight or concentration) of the oligomer or polymer exceeds the above-specified range, disadvantages such as retardation of dye diffusion tend to result.

The components composing the elements constituting the color diffusion transfer film unit of the present invention will be explained below.

I. Components and Layers Constituting Light-sensitive Element or Image-receiving Element A) Support:

Smooth and transparent or opaque supports generally used in photographic materials are used. Transparent supports include cellulose acetate, polystyrene, polyethylene terephthalate, and polycarbonate. A subbing layer is preferably provided on the support. A support preferably contains a trace amount of a dye or a pigment such as titanium oxide in order to prevent light piping.

A support has a thickness of 50 to 350 μm, preferably 70 to 210 μm, still preferably 80 to 150 μm.

An opaque support includes paper coated with or having laminated thereon a baryta layer, an α-olefin polymer (e.g., polyethylene, polypropylene, polyester, an ethylenebutene copolymer), and the above-mentioned transparent film to which a white pigment has been added.

If desired, a backing layer for curl balance or an oxygen-barrier layer (see JP-A-56-78833) may be provided on the back side of the support.

B) Image-Receiving Layer:

A dye image-receiving layer comprises a mordant in a hydrophilic colloid. The image-receiving layer may have a single layer structure or a multi-layer structure in which a plurality of mordants different in mordanting capability are integrated in layers. For the details of the multi-layered image-receiving layer, refer to JP-A-61-252551.

A polymer mordant is preferably used. A polymer mordant includes polymers containing a secondary or tertiary amino group, polymers having a nitrogen-containing heterocyclic moiety, and polymers containing a quaternary cation, each having a molecular weight of 5,000 or more, preferably 10,000 or more.

The mordant is applied in an amount usually of 0.5 to 10 $g/m^2$, preferably of 1.0 to 5.0 $g/cm^2$, still preferably of 2 to 4 $g/m^2$.

The hydrophilic colloid includes gelatin, polyvinyl alcohol, polyacrylamide, and polyvinyl pyrrolidone, with gelatin being preferred.

If desired, the image-receiving layer may contain a discoloration inhibitor as described in JP-A-62-30620, JP-A-62-30621, and JP-A-62-215272.

C) White Reflecting Layer:

A white reflecting layer serving as a white background for a color image generally comprises a white pigment and a hydrophilic binder. Suitable white pigments include barium sulfate, zinc oxide, barium stearate, silver flakes, silicates, alumina, zirconium oxide, sodium zirconium sulfate, kaolin, mica, and titanium dioxide. Non-film-forming polymer particles, such as polystyrene particles, may also serve for whiteness. These white pigments may be used either individually or as a mixture thereof so as to control the reflectance as desired. A particularly useful white pigment is titanium dioxide.

While the degree of whiteness of the white reflecting layer varies with the kind and coating amount of the pigment or the pigment to binder mixing ratio, the reflecting layer preferably has a reflectance of 70% or higher. In general, the degree of whiteness increases with the pigment content. However, since the pigment particles in the reflecting layer also act as a barrier against diffusion of an image-forming dye passing therethrough, the amount of the pigment to be applied should be selected properly.

For example, titanium dioxide is preferably used in an amount of 5 to 40 $g/m^2$, still preferably 10 to 25 $g/m^2$, to form a reflecting layer which reflects 78 to 85% of light having a wavelength of 540 nm.

Titanium dioxide to be used may be chosen from various grades available on the market. In particular, titanium dioxide of rutile type is preferred. Many of commercially available titanium dioxide grades have their surface treated with alumina, silica, zinc oxide, etc. It is preferable for assuring a high reflectance to use those grades having been surface-treated with 5% or more of such a surface treating agent. Examples of commercially available titanium dioxide grades include Ti-Pure R931 produced by E.I. du Pont de Nemours & Co., Inc. and those described in *Research Disclosure* No. 15162.

The hydrophilic binder to be used in the white reflecting layer includes alkali-penetrable high polymer matrices, such as gelatin, polyvinyl alcohol, and cellulose derivatives, e.g., hydroxyethyl cellulose, an carboxymethyl cellulose, with gelatin being particularly preferred for the white reflecting layer. A weight ratio of the white pigment to gelatin ranges from 1/1 to 20/1, preferably 5/1 to 10/1.

The white reflecting layer preferably contains such a discoloration inhibitor as disclosed in JP-B-62-30620 and JP-A-62-30621.

D) Light-Shielding Layer:

A light-shielding layer containing a light-shielding agent and a hydrophilic binder is provided between a white reflecting layer and a light-sensitive layer.

While any material having a light-shielding function may be employed as a light-shielding agent, carbon black is preferred. Degradable dyes described in U.S. Pat. No. 4,615,966 are also useful as a light-shielding agent.

The hydrophilic binder is not particularly limited as long as capable of dispersing carbon black. Gelatin is a preferred binder.

Carbon black to be used is not particularly limited by a method of production. For example, carbon black manufactured by a channel method, a thermal method, a furnace method, and the like as described in Donnel Voet, *Carbon Black*, Marcel Dekker, Inc. (1976) can be employed. While not limiting, the carbon black preferably has a particle size of 20 to 180 μm.

The amount of the black pigment as a light-shielding agent to be added is decided according to the sensitivity of a light-sensitive material to be shielded from light. In general, it corresponds to an optical density of about 5 to 10.

E) Light-Sensitive Layer:

In the present invention, a light-sensitive layer comprising a silver halide emulsion layer combined with a dye image-forming substance is provided above the above-mentioned light-shielding layer.

E-1) Dye Image-forming Substance:

The above-described dye image-forming substances can be used in the present invention.

E-2) Silver Halide Emulsion:

Silver halide emulsions which can be used in the present invention may be either negative emulsions which form a latent image mainly on the surface of silver halide grains or internal latent image type direct positive emulsions which form a latent image in the inside of silver halide grains.

The internal latent image type direct positive emulsions include so-called "conversion type" emulsions which are prepared by making use of a difference in solubility of silver halides and "core/shell type" emulsions in which at least the light-sensitive site of a silver halide internal nucleus (core) having been subjected to doping with a metallic ion and/or chemical sensitization is covered with a silver halide outer shell. The details for these emulsion types are described in U.S. Pat. Nos. 2,592,250 and 3,206,313, British Patent 1,027,146, U.S. Pat. Nos. 3,761,276, 3,935,014, 3,447,927, 2,297,875, 2,563,785, 3,551,662, and 4,395,478, West German Patent 2,728,108, and U.S. Pat. No. 4,431,730.

Where an internal latent image type direct positive emulsion is used, it is necessary to give silver halide grains a surface fogging nucleus after imagewise exposure by using light or a nucleating agent.

Nucleating agents to be used include hydrazines described in U.S. Pat. Nos. 2,563,785 and 2,588,982; hydrazines and hydrazones described in U.S. Pat. Nos. 3,227,552; heterocyclic quaternary salt compounds described in British Patent 1,283,835, JP-A-52-69613 and U.S. Pat. Nos. 3,615,615, 3,719,494, 3,734,738, 4,094,683, and 4,115,122; sensitizing dyes having in the dye molecule thereof a substituent having nucleating action described in U.S. Pat. No. 3,718,470; thiourea-bonded acylhydrazine compounds described in U.S. Pat. Nos. 4,030,925, 4,031,127, 4,245,037, 4,255,511, 4,266,013, and 4,276,364, and British Patent 2,012,443; and acylhydrazine compounds having bonded thereto a thioamide ring or a hetero ring, e.g., triazole or tetrazole, as an adsorbing group as described in U.S. Pat. Nos. 4,080,270 and 4,278,748, and British Patent 2,011,391B.

The above-mentioned negative emulsions or internal latent image type direct positive emulsions are used in combination with spectral sensitizing dyes. Specific examples of useful spectral sensitizing dyes are described in JP-A-59-180550, JP-A-60-140335, *Research Disclosure* 17029, and U.S. Pat. Nos. 1,846,300, 2,078,233, 2,089,129, 2,165,338, 2,231,658, 2,917,516, 3,352,857, 3,411,916, 2,295,276, 2,481,698, 2,688,545, 2,921,067, 3,282,933, 3,397,060, 3,660,103, 3,335,010, 3,352,680, 3,384,486, 3,623,881, 3,718,470, and 4,025,349.

(E-3) Constitution of Light-Sensitive Layer:

Reproduction of a natural color by a subtractive color process is achieved by using a light-sensitive layer comprising a combination of at least a light-sensitive emulsion spectrally sensitized with the above-described spectral sensitizing dye and the above-described dye image-forming substance providing a dye having a selective spectral absorption in the same wavelength range (hereinafter referred to as a combination unit). The emulsion and the dye image-forming substance may be provided in separate layers or may be mixed together and provided in one layer. Where a dye image-forming substance used is such that exhibits an absorption in the spectral sensitivity region of the emulsion with which it is combined when it is applied in layer, it is preferably provided in a separate layer. The emulsion layer may be comprised of a plurality of emulsion layers different in sensitivity. An arbitrary layer may be provided between an emulsion layer and a dye image-forming substance layer. For example, a layer containing a nucleation development accelerator described in JP-A-60-173541 or a partitioning layer described in JP-B-60-15267 may be provided to increase the dye image density, or a reflecting layer may be provided to increase the sensitivity of a light-sensitive element.

The reflecting layer comprises a white pigment, preferably titanium oxide, and a hydrophilic binder, preferably gelatin. Titanium oxide is applied in an amount of 0.1 to 8 $g/m^2$, preferably 0.2 to 4 $g/m^2$. Examples of suitable reflecting layers are described in JP-A-60-91354.

A preferred multi-layer structure of a light-sensitive layer comprises a blue-sensitive combination unit, a green-sensitive combination unit, and a red-sensitive combination unit in this order from the side to be exposed.

If desired, an arbitrary layer may be interposed among combination units. In particular, it is recommended to provide an intermediate layer between two combination units so as to prevent the development of an emulsion layer from adversely affecting the adjacent emulsion layer.

Where a development agent is used in combination with a nondiffusible dye image-forming substance, the intermediate layer preferably contains a nondiffusion reducing agent so as to prevent diffusion of an oxidation product of the developing agent. Such a nondiffusion reducing agent includes non-diffusing hydroquinone, sulfonamidophenol and sulfonamidonaphthol. Specific examples are described in JP-A-50-21249, JP-A-50-23813, JP-A-49-106329, JP-A-49-129535, U.S. Pat. Nos. 2,336,327, 2,360,290, 2,403,721, 2,544,640, 2,732,300, 2,782,659, 2,937,086, 3,637,393, and 3,700,453, British Patent 557,750, JP-A-57-24941, and JP-A-58-21249. Methods for preparing dispersions of these nondiffusion reducing agents are described in JP-A-60-238831 and JP-B-60-18978.

Where a compound capable of releasing a diffusing dye by a silver ion as described in JP-B-55-7576 is used, an intermediate layer containing a compound capturing the silver ion is preferably provided.

The light-sensitive layer may further comprise, if desired, an anti-irradiation layer, a UV-absorbing layer, a protective layer, and the like.

II. Components and Layers Constituting Neutralization Timing Element

F) Support:

The same as (A).

G) Layer with Neutralizing Function:

The layer having a neutralizing function is a layer containing a sufficient amount of an acidic substance for neutralizing the alkali carried over from the processing solution. If desired, the layer may have a multi-layered structure comprising a neutralization rate controlling layer (neutralization timing layer), a layer for assuring close contact with a light-sensitive element, and the like. The acidic substance is preferably a substance having an acidic group of pKa 9 or less (or a precursor group providing such an acidic group on hydrolysis). More preferred acidic substances include higher fatty acids, such as oleic acid, as described in U.S. Pat. No. 2,983,606; polymers of acrylic acid, methacrylic acid or maleic acid, or partial esters or acid anhydrides thereof as disclosed in U.S. Pat. No. 3,362,819; acrylic acid-acrylic ester copolymers as described in French Patent 2,290,699; and latex type acidic polymers as disclosed in U.S. Pat. No. 4,139,383 or *Research Disclosure* 16102 (1977).

In addition, the acidic substances described in U.S. Pat. No. 4,088,493, JP-A-52-153739, JP-A-53-1023, JP-A-53-4540, JP-A-53-4541, and JP-A-53-4542 are also useful.

Specific examples of the acidic polymers are copolymers of a vinyl monomer (e.g., ethylene, vinyl acetate or vinyl methyl ether) and maleic anhydride or an n-butyl ester thereof; butyl acrylate-acrylic acid copolymers; cellulose; and acetate hydrogenphthalate.

These acidic polymers may be used as mixed with a hydrophilic polymer, such as polyacrylamide, polymethyl pyrrolidone, polyvinyl alcohol (inclusive of partially saponified products), carboxymethyl cellulose, hydroxymethyl cellulose, hydroxyethyl cellulose, and polymethyl vinyl ether, with polyvinyl alcohol being preferred.

The acidic polymers may also be mixed with polymers other than hydrophilic ones, such as cellulose acetate.

The amount of the acidic polymer to be applied is decided by the amount of an alkali spread on the light-sensitive element. A suitable acidic polymer to alkali equivalent ratio per unit area ranges from 0.9 to 2.0, preferably from 1.0 to 1.3. Too small an amount of the acidic polymer tends to cause change in hue of a transferred dye or to stain the white background. Too large an amount also tends to result in change in hue or reduction in light-resistance.

The hydrophilic polymer used in combination also deteriorates the image quality if used in too large or too small an amount. A suitable weight ratio of hydrophilic polymer to acidic polymer is from 0.1 to 10, preferably 0.3 to 3.0.

The layer having a neutralizing function may contain additives for various purposes. For example, the layer may contain a hardening agent known to one skilled in the art or a polyhydroxy compound for improving brittleness, such as polyethylene glycol, polypropylene glycol or glycerin. Additionally, an antioxidant, a fluorescent whitening agent, a development inhibitor or a precursor thereof, and the like may also be incorporated into the layer according to necessity.

The neutralization timing layer to be combined with the neutralizing layer comprises, for example, polymers which reduce alkali permeability, such as gelatin, polyvinyl alcohol, a polyvinyl alcohol partial acetal, cellulose acetate, and a polyvinyl acetate partial hydrolysate; latex polymers which increase the energy required for activation of alkali permeation, such as those prepared by copolymerizing a small proportion of a hydrophilic comonomer (e.g., acrylic monomer); and polymers having a lactone ring.

Particularly useful among them are the timing layer using cellulose acetate disclosed in JP-A-54-136328 and U.S. Pat. Nos. 4,267,262, 4,009,030, and 4,029,849; the latex polymers prepared by copolymerizing a small proportion of a hydrophilic comonomer (e.g., acrylic acid) disclosed in JP-A-54-128335, JP-A-56-69629, JP-A-57-6843, and U.S. Pat. Nos. 4,056,394, 4,061,496, 4,199,362, 4,250,243, 4,256,827, and 4,268,604; the polymers having a lactone ring disclosed in U.S. Pat. No. 4,229,516; and the polymers described in JP-A-56-25735, JP-A-56-97346, JP-A-57-6842, EP-A1-31957, EP-A1-37724, and EP-A1-48412.

In addition, materials described in U.S. Pat. Nos. 3,421,893, 3,455,686, 3,575,701, 3,778,265, 3,785,815, 3,847,615, 4,088,493, 4,123,275, 4,148,653, 4,201,587, 4,288,523, and 4,297,431, West German Patent Publication OLS Nos. 1,622,936 and 2,162,277, and *Research Disclosure* 15162, No. 151 (1976) are also useful.

The neutralization timing layer may have a single layer structure or a multi-layer structure composed of two or more layers.

It is possible to incorporate photographically useful additives (or precursors thereof) into the timing layer. Examples of the photographically useful additives, for example, include development inhibitors and/or precursors thereof disclosed in U.S. Pat. No. 4,009,029, West German Patent Publication OLS Nos. 2,913,164 and 3,014,672, JP-A-54-155837 and JP-A-55-138745 and hydroquinone precursors disclosed in U.S. Pat. No. 4,201,578.

For minimizing reduction of changes in transferred image density with time after processing, it is effective to provide an auxiliary neutralizing layer as a layer having a neutralization function as proposed in JP-A-63-168648 and JP-A-63-168649.

III. Processing Solution

The processing solution is uniformly spread on a light-sensitive element after exposure of the light-sensitive element to develop the light-sensitive material and, at the same time, serves to completely shield the light-sensitive layer from the outside light in cooperation with a light-shielding layer provided on the back of the support of the light-sensitive element or on the side opposite to the processing solution. Accordingly, the processing composition usually contains an alkali, a thickener, a light-shielding agent, a developing agent, a development controlling agent (e.g., a development accelerator or a development inhibitor), an antioxidant for preventing deterioration of a developing agent, and the like. The light-shielding agent is an essential component of the processing composition.

The alkali is used in an amount enough to adjust the composition to pH between 12 and 14. Suitable alkalis include alkali metal hydroxides, such as sodium hydroxide, potassium hydroxide, and lithium hydroxide; alkali metal phosphates, such as potassium phosphate; guanidine derivatives; and quaternary amine hydroxides, such as tetramethylammonium hydroxide; with potassium hydroxide and sodium hydroxide being preferred.

The thickener is necessary for making the processing solution uniformly spreadable and for assuring intimate contact between a light-sensitive layer and a cover sheet. Useful thickeners include polyvinyl alcohol, hydroxyethyl cellulose, and alkali metal salts of carboxymethyl cellulose, with hydroxyethyl cellulose and sodium carboxymethyl cellulose being preferred.

The light-shielding agent includes any kind of dyes and pigments and mixtures thereof as long as it does not diffuse into a dye image-receiving layer to cause stains. Carbon black is a typical light-shielding agent.

The developing agent includes all the kinds known in the art as long as it is capable of cross oxidizing a dye-forming substance and causes no substantial stains even when oxidized. The developing agent may be used either individually or as a combination of two or more thereof. It may be used in the form of a precursor thereof. The developing agent may be incorporated into either an appropriate layer of a light-sensitive element or an alkali processing solution. Useful developing agents include aminophenol derivatives and pyrazolidinone derivatives, with pyrazolidinone derivatives being preferred for suppression of stains.

Examples of the pyrazolidinone developing agents are 1-phenyl-3-pyrazolidinone, 1-p-tolyl-4,4-dihydroxymethyl-3-pyrazolidinone, 1-(3'-methylphenyl)-4-methyl-4-hydroxymethyl-3-pyrazolidinone, 1-phenyl-4-methyl-4-hydroxymethyl-3-pyrazolidinone, and 1-p-tolyl-4-methyl-4-hydroxymethyl-3-pyrazolidinone.

A light-sensitive sheet, a cover sheet or an alkali processing solution may contain a development accelerator described in JP-A-62-215272, pp. 72–91, a hardening agent described in ibid, pp. 146–155, a surface active agent described in ibid, pp. 201–210, a fluorine-containing compound described in ibid, pp. 210–222, a thickener described in ibid, pp. 225–227, an antistatic agent described in ibid, pp. 227–230, a polymer latex described in ibid, pp. 230–239, and a matting agent described in ibid, p. 240.

IV. Others

H) Auxiliary Layers:

The element described in I and II above may further have layers having an auxiliary function, such as a backing layer, a protective layer, and a filter dye layer.

The backing layer is for prevention of curling and for improving slip properties. A filter dye may be added to the backing layer.

The protective layer is for prevention of blocking between the surface and the back side of each element and for prevention of blocking between two elements, for example, where a light-sensitive element and a neutralization timing element are laid one another.

A dye may be added to a neutralization timing element, etc. for adjusting the sensitivity of a light-sensitive layer.

A filter dye may either be added directly to the support of a neutralization timing element, a layer having a neutralizing function, or the aforesaid auxiliary layer (e.g., a backing layer, a protective layer or a capturing mordanted layer) or be provided as an independent layer.

I) Release Layer:

In the case of peel-apart type film units, a release layer can be provided at an arbitrary position of a light-sensitive element or an image-receiving element so that the film unit may be separated at that position into two parts after processing. Accordingly, a release layer should be such that facilitates stripping after processing. Materials which can be used for such a release layer are described in JP-A-47-8237, JP-A-59-220727, JP-A-59-229555, JP-A-49-4653, U.S. Pat. Nos. 3,220,835 and 4,359,518, JP-A-49-4334, JP-A-56-65133, JP-A-45-24075, and U.S. Pat. Nos. 3,227,550, 2,759,825, 4,401,746, and 4,366,227. Specific examples of the materials include water-soluble (or alkali-soluble) cellulose derivatives, such as hydroxyethyl cellulose, cellulose acetate phthalate, plasticized methyl cellulose, ethyl cellulose, cellulose nitrate, and carboxymethyl cellulose; naturally-occur-ring high polymers, such as alginic acid, pectin, and gum arabic; various modified gelatin species, such as acetylated gelatin and phthalated gelatin; and water-soluble synthetic polymers, such as polyvinyl alcohol, polyacrylate, polymethyl methacrylate, polybutyl methacrylate, and copolymers thereof.

The release layer may have a single layer structure or, as described in JP-A-59-220727 or JP-A-60-60642, may have a multi-layered structure.

The present invention will now be illustrated in greater detail with reference to Reference Examples and Examples, but it should be understood that the present invention is not deemed to be limited thereto. All the percents are given by weight unless otherwise indicated.

REFERENCE EXAMPLE 1

Aqueous dispersions of carbon black 1A to 1S were prepared as follows.

Carbon black (Columbia Carbon R-450) 350 g

Surface active agent (Alkanol B, produced by E.I. du Pont) 17.5 g

Water 650 cc

The above components were dispersed in a colloid mill for 3 days to prepare dispersion 1A.

Dispersion 1B was prepared in the same manner as for dispersion 1A, except for additionally using 21 g of polyvinyl alcohol having a degree of saponification of 98% and a degree of polymerization of about 300.

Dispersions IC and ID were prepared in the same manner as for dispersion 1A, except for additionally using 21 g of sodium polyacrylate and polyacrylamide, respectively, both having a degree of polymerization of about 1000.

Dispersions 1E to 1S were prepared in the same manner as for dispersion 1A, except for additionally using 21 g of each of the oligomers or polymers according to the present invention, P-2, P-16, P-18, P-26, P-30, P-36, P-37, P-42, P-47, P-50, P-51, P-52, P-56, P-61, and P-64, respectively.

The particle size distribution of each carbon black dispersion was measured with a particle size analyzer NICOMP Model 200E, manufactured by HIAC/ROYCO Co., and expressed in terms of volume average particle size. The results obtained are shown in Table 1 below. The dispersion stability was evaluated by preserving each dispersion at 25° C. for 30 days and obtaining the average particle size in the same manner as above. The results obtained are shown in parentheses in Table 1.

TABLE 1

Stability of Carbon Black Dispersion

| Dispersion No. | Average Particle Size (μm) | Remark |
|---|---|---|
| 1A | 0.63 (0.89) | Comparison |
| 1B | 0.65 (sedimentation) | " |
| 1C | 0.64 (sedimentation) | " |
| 1D | 0.62 (sedimentation) | " |
| 1E | 0.51 (0.72) | Invention |
| 1F | 0.53 (0.75) | " |
| 1G | 0.50 (0.67) | " |
| 1H | 0.44 (0.57) | " |
| 1I | 0.48 (0.49) | " |
| 1J | 0.46 (0.49) | " |
| 1K | 0.47 (0.47) | " |
| 1L | 0.46 (0.47) | " |
| 1M | 0.48 (0.51) | " |
| 1N | 0.49 (0.61) | " |

TABLE 1-continued

Stability of Carbon Black Dispersion

| Dispersion No. | Average Particle Size (μm) | Remark |
|---|---|---|
| 1O | 0.48 (0.52) | " |
| 1P | 0.44 (0.46) | " |
| 1Q | 0.42 (0.44) | " |
| 1R | 0.45 (0.45) | " |
| 1S | 0.47 (0.49) | " |

The results in Table 1 prove that the oligomer or polymer according to the present invention has an effect on stabilization of a carbon black dispersion and that, among the oligomers or polymers, those of block copolymer type, graft copolymer type and terminal group reaction type are particularly effective.

REFERENCE EXAMPLE 2

Aqueous dispersions of titanium dioxide 2A to 2S were prepared as follows.

Rutile type titanium dioxide 600 g

Water 391 cc

Carboxymethyl cellulose having an average molecular weight of 3000 5 g

Lime-processed gelatin 4 g

The above components were dispersed in a colloid mill for 7 days to prepare dispersion 2A.

Dispersion 2B was prepared in the same manner as for dispersion 2A, except for replacing carboxymethyl cellulose with 21 g of polyvinyl alcohol having a degree of saponification of 98% and a degree of polymerization of about 300.

Dispersions 2C and 2D were prepared in the same manner as for dispersion 2A, except for using 21 g of sodium polyacrylate and polyacrylamide, respectively, both having a degree of polymerization of about 1000.

Further, dispersions 2E to 2S were prepared in the same manner as for dispersion 2A, except for using 21 g of each of the oligomers or polymers according to the present invention, P-2, P-16, P-18, P-26, P-30, P-36, P-37, P-42, P-47, P-50, P-51, P-52, P-56, P-61, and P-64, respectively.

The stability of the resulting dispersions was evaluated (coagulation test) as follows. A hundred grams of each dispersion was added at a rate of 200 g/10 sec to 1 l of a 2% aqueous solution of gelatin kept at 40° C. while stirring at 180 rpm. After the addition, the mixture was allowed to stand for 1 day and filtered using a filter having a pore size of 30 μm, and titanium dioxide in the filter cake was weighed. The results obtained for Dispersions 2A to 2S are shown in Table 2.

TABLE 2

Stability of Titanium Dioxide Dispersion

| Dispersion No. | Amount of $TiO_2$ Sediment (wt %) | Remark |
|---|---|---|
| 2A | 6 | Comparison |
| 2B | 85 | " |
| 2C | 81 | " |
| 2D | 78 | " |
| 2E | 0.9 | Invention |
| 2F | 0.8 | " |
| 2G | 1.1 | " |

TABLE 2-continued

| Stability of Titanium Dioxide Dispersion | | |
|---|---|---|
| Dispersion No. | Amount of $TiO_2$ Sediment (wt %) | Remark |
| 2H | 0.4 | " |
| 2I | 0.1 | " |
| 2J | 0.2 | " |
| 2K | 0.3 | " |
| 2L | 0.2 | " |
| 2M | 0.2 | " |
| 2N | 0.4 | " |
| 2O | 0.2 | " |
| 2P | 0.2 | " |
| 2Q | 0.1 | " |
| 2R | 0.2 | " |
| 2S | 0.2 | " |

As can be seen from the above results, the oligomers or polymers according to the present invention are also effective on stabilization of dispersions of titanium dioxide, and among the oligomers or polymers, those of block copolymer type, graft copolymer type and terminal group reaction type are particularly effective.

REFERENCE EXAMPLE 3

Magenta dye-releasing compound dispersions 3A to 3S were prepared as follows.

Magenta dye-releasing compound of formula: 100 g

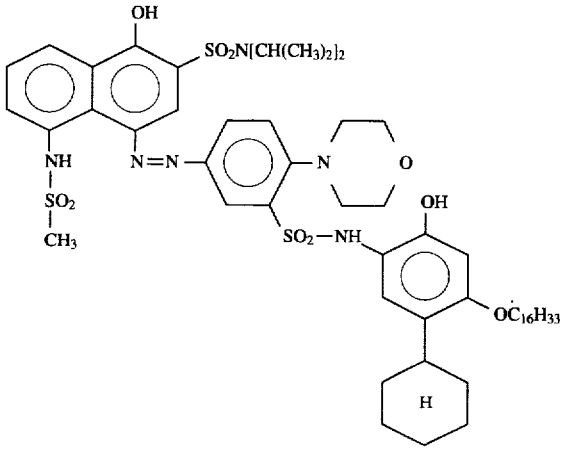

Surface active agent Alkanol B 8 g

Tricyclohexyl phosphate 30 g

Methyl ethyl ketone 500 cc

The above components were heated to melt, and 1100 cc of water was added to the molten mixture. The mixture was dispersed in a homogenizer. The resulting dispersion was subjected to ultrafiltration using an ultrafiltration module AC-3050, manufactured by Asahi Chemical Industry Co., Ltd., until the methyl ethyl ketone concentration became 1% or less to prepare dispersion 3A.

Dispersion 3B was prepared in the same manner as for dispersion 3A, except for using 21 g of polyvinyl alcohol having a degree of saponification of 98% and a degree of polymerization of about 300.

Dispersions 3C and 3D were prepared in the same manner as for dispersion 3A, except for using 21 g of sodium polyacrylate and polyacrylamide both having a degree of polymerization of about 1000, respectively.

Further, dispersions 3E to 3S were prepared in the same manner as for dispersion 3A, except for using 21 g of each of the oligomers or polymers according to the present invention, P-2, P-16, P-18, P-26, P-30, P-36, P-37, P-42, P-47, P-50, P-51, P-52, P-56, P-61, and P-64, respectively.

Each of dispersions 3A to 3S immediately after the preparation and after being preserved at 5° C. for 30 days was filtered through a filter having a pore size of 10 μm, and the filtration pressure was measured to see if any increase in filtration pressure with time was observed. Dispersions showing substantially no increase in filtration pressure were rated "good", those showing a slight increase in filtration pressure were rated "medium", and those showing a great increase in filtration pressure were rated "bad". Dispersions that could not be filtered were rated "very bad". The results obtained are shown in Table 3.

REFERENCE EXAMPLE 4

Dispersions 4A to 4S were prepared in the same manner as in Reference Example 3 except for replacing the magenta dye-releasing compound with a cyan dye-releasing compound of formula:

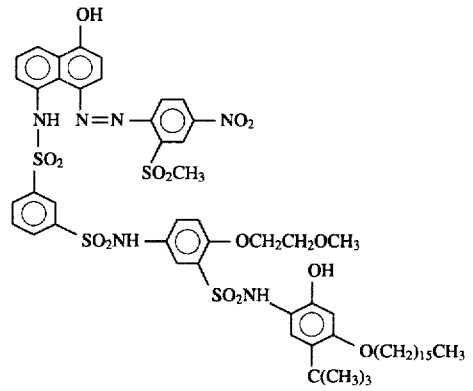

The stability of the resulting dispersions was evaluated in the same manner as in Reference Example 3. The results obtained are shown in Table 3.

TABLE 3

| Stability of Dye-Releasing Compound Dispersion | | | |
|---|---|---|---|
| Magenta Dye-Releasing Compound | | Cyan Dye-Releasing Compound | |
| Dispersion No. | Filter-ability | Dispersion No. | Filter-ability |
| 3A (Comparison) | very bad | 4A (Comparison) | very bad |
| 3B (Comparison) | bad | 4B (Comparison) | bad |
| 3C (Comparison) | bad | 4C (Comparison) | bad |
| 3D (Comparison) | bad | 4D (Comparison) | bad |
| 3E (Invention) | medium | 4E (Invention) | medium |
| 3F (Invention) | medium | 4F (Invention) | medium |
| 3G (Invention) | medium | 4G (Invention) | medium |
| 3H (Invention) | good | 4H (Invention) | good |
| 3I (Invention) | good | 4J (Invention) | good |
| 3J (Invention) | good | 4J (Invention) | good |

TABLE 3-continued

| Stability of Dye-Releasing Compound Dispersion | | | |
|---|---|---|---|
| Magenta Dye-Releasing Compound | | Cyan Dye-Releasing Compound | |
| Dispersion No. | Filter-ability | Dispersion No. | Filter-ability |
| 3K (Invention) | good | 4K (Invention) | good |
| 3L (Invention) | good | 4L (Invention) | good |
| 3M (Invention) | good | 4M (Invention) | good |
| 3N (Invention) | good | 4N (Invention) | good |
| 3O (Invention) | good | 4O (Invention) | good |
| 3P (Invention) | good | 4P (Invention) | good |
| 3Q (Invention) | good | 4Q (Invention) | good |
| 3R (Invention) | good | 4R (Invention) | good |
| 3S (Invention) | good | 4S (Invention) | good |

It can be seen that the oligomer or polymer of the present invention is effective on stabilization of a dispersion of not only a magenta dye-releasing compound but a cyan dye-releasing compound and that, among the oligomers or polymers, those of block copolymer type, graft copolymer type and terminal group reaction type are particularly effective.

EXAMPLE 1

1) Preparation of Light-Sensitive Element (A)

Light-sensitive elements A having the layer structure shown in Table 4 below were prepared. In the Table, the coating weights as for silver halide light-sensitive emulsions are given in terms of silver (g-Ag/m$^2$).

TABLE 4

| Layer No. | Function | Components | Coating Weight (g/m$^2$) |
|---|---|---|---|
| 21 | Protective layer | Gelatin | 0.4 |
| | | Matting agent (1) | 0.25 |
| 20 | UV absorbing layer | Gelatin | 0.50 |
| | | UV absorbent (1) | $4.0 \times 10^{-4}$ |
| | | UV absorbent (2) | $4.0 \times 10^{-4}$ |
| 19 | Yellow-sensitive layer (high-sensitive) | Internal latent image type direct positive emulsion (octahedral grains; grain size: 1.7 μm) | 0.60-Ag |
| | | Sensitizing dye (3) | $1.4 \times 10^{-3}$ |
| | | Nucleating agent (1) | $6.8 \times 10^{-3}$ |
| | | Additive (2) | 0.03 |
| | | Gelatin | 0.70 |
| 18 | Yellow-sensitive layer (low-sensitive) | Internal latent image type direct positive emulsion (octahedral grains; grain size: 1.1 μm) | 0.25-Ag |
| | | Sensitizing dye (3) | $9.0 \times 10^{-4}$ |
| | | Nucleating agent (1) | $8.0 \times 10^{-3}$ |
| | | Additive (2) | $4.5 \times 10^{-2}$ |
| | | Gelatin | 0.40 |
| 17 | White reflecting layer | Titanium dioxide | 0.70 |
| | | Gelatin | 0.18 |
| 16 | Yellow dye layer | Yellow dye-releasing compound (1) | 0.53 |
| | | High-boiling organic solvent (1) | 0.13 |
| | | Additive (1) | $1.4 \times 10^{-2}$ |
| | | Gelatin | 0.70 |
| 15 | Intermediate layer | Gelatin | 0.30 |
| 14 | Color mixing preventive layer | Additive (1) | 0.80 |
| | | Polymethyl methacrylate | 0.80 |
| | | Gelatin | 0.45 |
| 13 | Green-sensitive layer (high-sensitive) | Internal latent image type direct positive emulsion (octahedral grains; grain size: 1.6 μm) | 0.80-Ag |
| | | Sensitizing dye (2) | $2.1 \times 10^{-3}$ |
| | | Nucleating agent (1) | $2.5 \times 10^{-3}$ |
| | | Additive (2) | 0.08 |
| | | Gelatin | 1.00 |
| 12 | Green-sensitive layer (low-sensitive) | Internal latent image type direct positive emulsion (octahedral grains; grain size: 1.0 μm) | 0.25-Ag |
| | | Sensitizing dye (2) | $1.1 \times 10^{-3}$ |
| | | Nucleating agent (1) | $4.4 \times 10^{-3}$ |
| | | Additive (2) | 0.03 |
| | | Gelatin | 0.50 |
| 11 | White reflecting layer | Titanium dioxide | 1.00 |
| | | Gelatin | 0.25 |
| 10 | Magenta dye layer | Magenta dye-releasing compound (1) | 0.50 |
| | | High-boiling organic solvent (1) | 0.15 |
| | | Additive (1) | $9.0 \times 10^{-3}$ |
| | | Gelatin | 0.4 |
| 9 | Intermediate layer | Gelatin | 0.30 |
| 8 | Color mixing preventive layer | Additive (1) | 1.20 |
| | | Polymethyl methacrylate | 1.20 |
| | | Gelatin | 0.70 |
| 7 | Red-sensitive layer (high-sensitive) | Internal latent image type direct positive emulsion (octahedral grain; grain size: 1.6 μm) | 0.50-Ag |
| | | Sensitizing dye (1) | $6.2 \times 10^{-4}$ |
| | | Nucleating agent (1) | $5.0 \times 10^{-3}$ |
| | | Additive (2) | 0.04 |
| | | Gelatin | 1.80 |
| 6 | Red-sensitive layer (low-sensitive) | Internal latent image type direct positive emulsion (octahedral grains; grain size: 1.0 μm) | 0.15-Ag |
| | | Sensitizing dye (1) | $3.0 \times 10^{-4}$ |
| | | Nucleating agent (1) | $5.0 \times 10^{-3}$ |
| | | Additive (2) | 0.02 |
| | | Gelatin | 0.40 |
| 5 | White reflecting layer | Titanium dioxide | 3.00 |
| | | Gelatin | 0.80 |
| 4 | Cyan dye layer | Cyan dye-releasing compound (1) | 0.50 |
| | | High-boiling organic solvent (1) | 0.10 |
| | | Additive (1) | 0.01 |
| | | Gelatin | 0.4 |
| 3 | Opaque layer | Carbon black | 1.70 |
| | | Gelatin | 1.2 |
| 2 | White reflecting layer | Titanium dioxide | 19.0 |
| | | Gelatin | 2.0 |
| 1 | Image-receiving layer | Polymer mordant (1) | 3.2 |
| | | Gelatin | 3.00 |
| Support | | Polyethylene terephthalate (thickness: 90 μm) | |

The compounds used in light-sensitive element A were as follows.

Polymer Mordant (1):

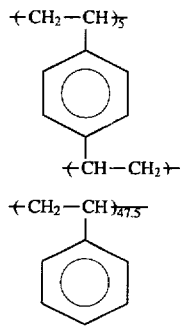

-continued

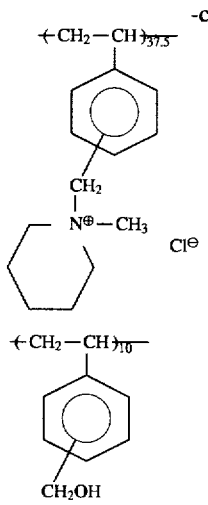

UV Absorbent (1):

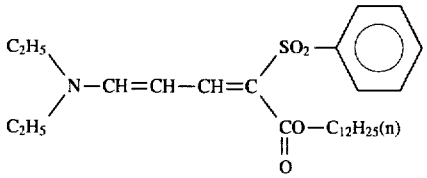

UV Absorbent (2):

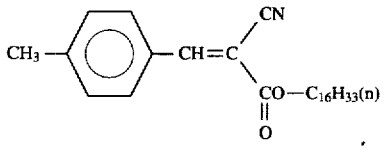

Matting Agent (1):

Polymethyl methacrylate latex (spherical particles; average particle size: 4 μm)

Cyan Dye-Releasing Compound (1):

The same as used in Reference Example 4.

Magenta Dye-Releasing Compound (1):

The same as used in Reference Example 3.

Yellow Dye-Releasing Compound (1):

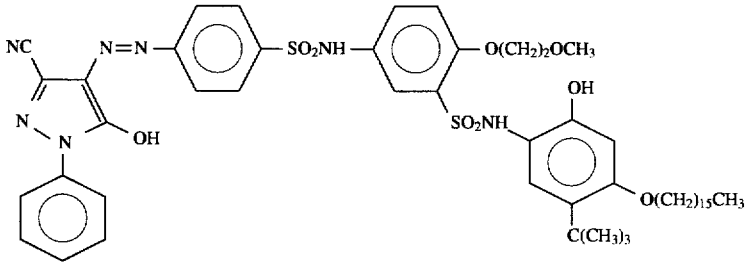

Additive (1):

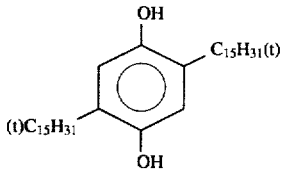

Additive (2):

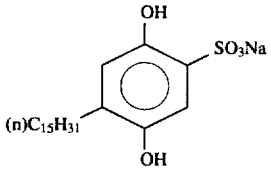

High-Boiling Organic Solvent (1):

Tricyclohexyl phosphate

Nucleating Agent (1):

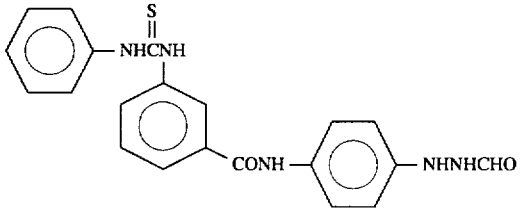

Sensitizing Dye (1):

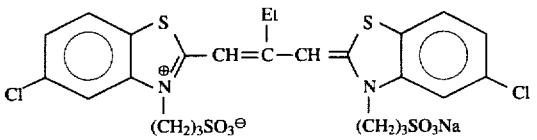

Sensitizing Dye (2):

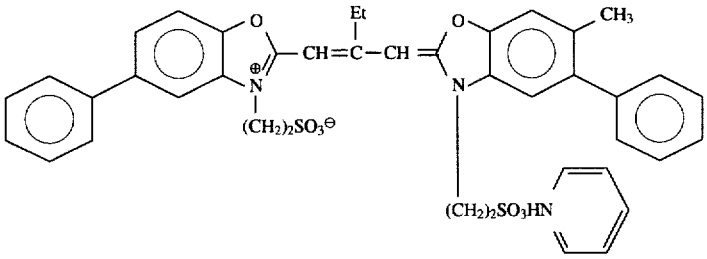

Sensitizing Dye (3):

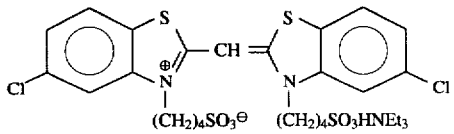

Light-sensitive elements 5B to 5S were prepared using each of dispersions 3B to 3S of Reference Example 3 immediately after their preparation as a magenta dye-releasing compound in the 10th layer.

2) Preparation of Neutralization Timing Element (Cover Sheet)

A polyethylene terephthalate transparent film containing therein a dye for preventing light piping and having thereon a gelatin subbing layer was coated with layers (1) to (3) shown below in the order listed to obtain a cover sheet.

(1) A neutralizing layer consisting of 10.4 g/m$^2$ of an acrylic acid/butyl acrylate (8:2 by mole) copolymer having an average molecular weight of 50,000 and 0.1 g/m$^2$ of 1,4-bis(2,3-epoxypropoxy)butane.

(2) A neutralization timing layer consisting of 4.3 g/m$^2$ of acetyl cellulose having a degree of acetylation of 51% and 0.2 g/m$^2$ of poly(methyl vinyl ether-monomethyl maleate).

(3) A layer having a total solid content of 1.0 g/m$^2$ which comprised a 6:4 (on a solid basis) mixture of a polymer latex prepared by emulsion polymerization of styrene, butyl acrylate, acrylic acid, and N-methylolacrylamide at a ratio of 49.7/42.3/4/4 by weight and a polymer latex prepared by emulsion polymerization of methyl methacrylate, acrylic acid, and N-methylolacrylamide at a ratio of 93/3/4 by weight.

3) Preparation of Processing Element

A highly viscous alkali processing solution was prepared according to the following formulation and packed in destroyable containers. The resulting processing solution was designated PA.

Formulation of Processing Solution PA:

1-p-Tolyl-4-hydroxymethyl-4-methyl-3-pyrazolidone 10.0 g

Methylhydroquinone 0.18 g

5-Methylbenzotriazole 3.0 g

Sodium sulfite (anhydrous) 0.2 g

Benzyl alcohol 1.5 cc

Sodium carboxymethyl cellulose 58 g

Carbon black 150 g

Potassium hydroxide (28% aqueous solution) 200 cc

Water 680 cc

4) Development and Evaluation

Each light-sensitive element 5B to 5S was exposed to light of square wave from the emulsion layer side, and the cover sheet was superposed thereon. Processing solution PA was spread between the light-sensitive element and the cover sheet to a thickness of 72 μm by means of a pressure roller.

The reflective magenta density was measured with a microdensitometer to calculate a contract transfer function (CTF) indicative of sharpness. A spatial frequency (cycle/mm) which gave a CTF value of 0.5 was obtained. The results are shown in Table 5.

Further, the cover sheet was superposed on each of unexposed light-sensitive elements 5B to 5S, and processing solution PS was spread therebetween in the same manner as described above. The magenta reflective density was measured with time. The time required for the magenta density to reach 1.4 (time of transfer) (transfer speed) is also shown in Table 5.

TABLE 5

Magenta Sharpness and Transfer Speed

| Light-Sensitive Element | Sharpness (c/mm) | Time of Transfer (min) | Remark |
|---|---|---|---|
| 5B | 2.8 | 2.9 | Comparison |
| 5C | 2.8 | 2.9 | " |
| 5D | 2.8 | 2.9 | " |
| 5E | 3.2 | 2.6 | Invention |
| 5F | 3.2 | 2.5 | " |
| 5G | 3.2 | 2.6 | " |
| 5H | 3.2 | 2.6 | " |
| 5I | 3.4 | 2.5 | " |
| 5J | 3.2 | 2.6 | " |
| 5K | 3.3 | 2.6 | " |
| 5L | 3.3 | 2.6 | " |
| 5M | 3.3 | 2.6 | " |
| 5N | 3.3 | 2.6 | " |
| 5O | 3.3 | 2.6 | " |
| 5P | 3.3 | 2.6 | " |
| 5Q | 3.4 | 2.5 | " |
| 5R | 3.3 | 2.6 | " |
| 5S | 3.3 | 2.6 | " |

The results of Table 5 reveal that light-sensitive elements prepared using the oligomer or polymer according to the present invention exhibit improved sharpness while showing accelerated transfer. Considering that acceleration of image formation by any means other than reduction of film thickness has usually been accompanied by deterioration of sharpness in a color diffusion transfer system, these effects are beyond expectation.

EXAMPLE 2

Light-sensitive elements 6A to 6S having the layer structure shown in Table 4 of Example 1 were prepared using each of dispersions 1A to 1S, respectively, as a carbon black dispersion of the 3rd layer.

The light-sensitive element was uniformly exposed to light of 20 CMS from the emulsion layer side, the same cover sheet as used in Example 1 was superposed thereon, and processing solution PA prepared in Example 1 was spread therebetween to a thickness of 50 μm at 10° C. Immediately after the processing, the light-sensitive element side was irradiated with light of 100,000 lux for 10 minutes. After the irradiation, the number of spots appearing on the white background was counted. The results obtained are shown in Table 6, relatively expressed taking the number of spots of light-sensitive element 6A (comparison) as a standard (1000).

Light-sensitive elements 6T and 6U according to the present invention were prepared in the same manner as described above, except for using dispersion 6Q in the 3rd layer and reducing the coating weight of the 3rd layer by 10% and 20%, respectively. As a result of the same processing and evaluation as described above, the number of spots of 6T and 6U was 19 times and 46 times, respectively, that of 6Q.

Further, the magenta sharpness and the time of transfer of light-sensitive elements 6A to 6U were measured in the same manner as in Example 1. The results obtained are shown in Table 6.

TABLE 6

Light-Shielding Ability, Magenta Sharpness and Transfer Speed

| Light-Sensitive Element | Number of Spots | Sharpness (c/mm) | Time of Transfer (min) | Remark |
|---|---|---|---|---|
| 6A | 1000 | 3.1 | 2.8 | Comparison |
| 6B | 940 | 3.1 | 2.75 | " |
| 6C | 980 | 3.1 | 2.8 | " |
| 6D | 950 | 3.1 | 2.8 | " |
| 6E | 44 | 3.3 | 2.6 | Invention |
| 6F | 46 | 3.3 | 2.6 | " |

TABLE 6-continued

Light-Shielding Ability, Magenta Sharpness and Transfer Speed

| Light-Sensitive Element | Number of Spots | Sharpness (c/mm) | Time of Transfer (min) | Remark |
|---|---|---|---|---|
| 6G | 44 | 3.3 | 2.55 | " |
| 6H | 42 | 3.3 | 2.6 | " |
| 6I | 30 | 3.5 | 2.45 | " |
| 6J | 37 | 3.4 | 2.5 | " |
| 6K | 31 | 3.4 | 2.5 | " |
| 6L | 32 | 3.4 | 2.5 | " |
| 6M | 40 | 3.3 | 2.6 | " |
| 6N | 44 | 3.3 | 2.6 | " |
| 6O | 32 | 3.4 | 2.6 | " |
| 6P | 34 | 3.4 | 2.5 | " |
| 6Q | 28 | 3.5 | 2.45 | " |
| 6R | 32 | 3.4 | 2.5 | " |
| 6S | 33 | 3.4 | 2.5 | " |
| 6T | 320 | 3.8 | 2.1 | " |
| 6U | 240 | 3.7 | 2.2 | " |

It is seen that the light-sensitive element containing the oligomer or polymer of the present invention as a dispersant for carbon black provides a film unit exhibiting high light-shielding ability, accelerated transfer, and high image sharpness. It is also seen that use of the oligomer or polymer makes it possible to reduce the amount of the dispersion to be applied. Among the oligomers or polymers of the present invention, those of block copolymer type and terminal group reaction type gave better results.

EXAMPLE 3

Use of the dispersions 3B to 3S of Reference Example 3 in the 5th layer containing magenta dye-releasing redox compound of a color diffusion transfer film unit having the following structure was tested in the same manner as in Example 1. As a result, the oligomers or polymers of the present invention produced the same effects as observed in Example 1.

Light-Sensitive Element B:

A polyethylene terephthalate transparent support was coated with the following layers to prepare a light-sensitive sheet.

Backing Layer:

A light-shielding layer consisting of 4.0 g/m$^2$ of carbon black and 2.0 g/m$^2$ of gelatin.

Emulsion Layers:

(1) A layer consisting of 0.44 g/m$^2$ of a cyan dye-releasing redox compound of formula:

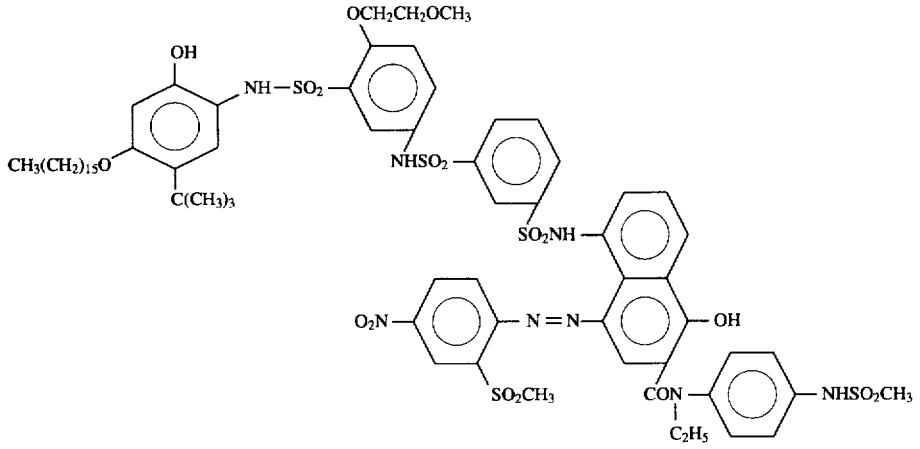

0.09 g/m$^2$ of tricyclohexyl phosphate, 0.008 g/m$^2$ of 2,5-di-t-pentadecylhydroquinone, and 0.8 g/m$^2$ of gelatin.

(2) A layer consisting of 0.5 g/m$^2$ of gelatin.

(3) A red-sensitive emulsion layer consisting of 0.6 g/m$^2$, in terms of silver, of a red-sensitive internal latent image type direct positive silver bromide emulsion, 1.2 g/m$^2$ of gelatin, 0.015 g/m$^2$ of a nucleating agent of formula:

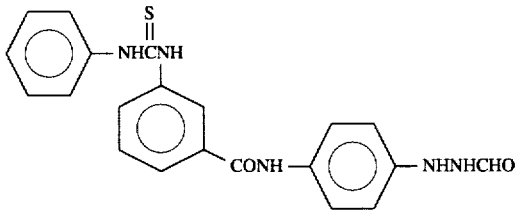

and 0.06 g/m$^2$ of sodium 2-sulfo-5-n-pentadecylhydroquinone.

(4) A layer consisting of 0.43 g/m$^2$ of 2,5-di-t-pentadecylhydroquinone, 0.1 g/m$^2$ of trihexyl phosphate, and 0.4 g/m$^2$ of gelatin.

(5) A layer consisting of 0.3 g/m$^2$ of a magenta dye-releasing redox compound of formula:

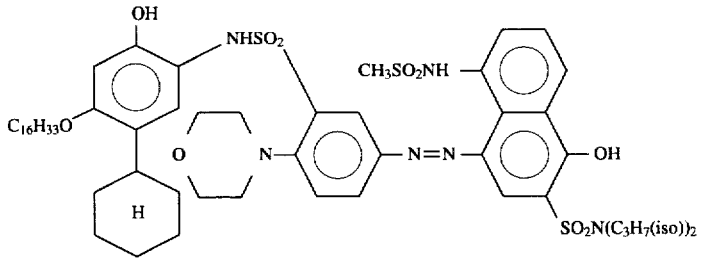

0.08 g/m$^2$ of tricyclohexyl phosphate, 0.009 g/m$^2$ of 2,5-di-t-pentadecylhydroquinone, and 0.5 g/m$^2$ of gelatin.

(6) A green-sensitive emulsion layer consisting of 0.42 g/m$^2$ in terms of silver, of a green-sensitive internal latent image type direct positive silver bromide emulsion, 0.9 g/m$^2$ of gelatin, 0.013 g/m$^2$ of the same nucleating agent as used in layer (3), and 0.07 g/m$^2$ of sodium 2-sulfo-5-n-pentadecylhydroquinone.

(7) The same layer as layer (4).

(8) A layer consisting of 0.53 g/m$^2$ of a yellow dye-releasing redox compound of formula:

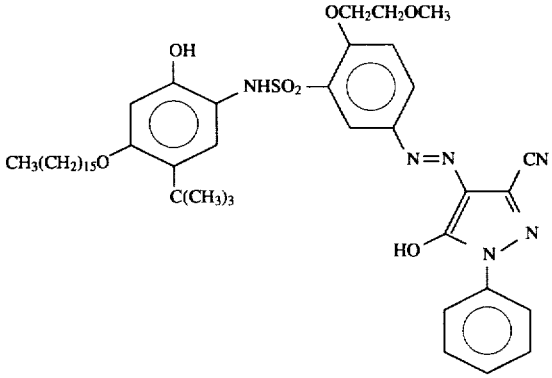

0.13 g/m$^2$ of tricyclohexyl phosphate, 0.014 g/m$^2$ of 2,5-di-t-pentadecylhydroquinone, and 0.7 g/m$^2$ of gelatin.

(9) A blue-sensitive emulsion layer consisting of 0.6 g/m$^2$, in terms of silver, of a blue-sensitive internal latent image type direct positive silver bromide emulsion, 1.1 g/m$^2$ of gelatin, 0.019 g/m$^2$ of the same nucleating agent as used in layer (3), and 0.05 g/m$^2$ of sodium 2-sulfo-5-n-pentadecylhydroquinone.

(10) A layer consisting of 1 g/m$^2$ of gelatin.

Image-Receiving Sheet (dye fixing element):

An image-receiving sheet having the layer structure shown in Table 7 was prepared.

TABLE 7

| Layer No. | Layer Function | Component | Coating Weight ($g/m^2$) |
|---|---|---|---|
| F6 | Protective layer | Gelatin | 0.6 |
| F5 | Mordanting layer | Gelatin | 3.0 |
| | | Mordant (A) | 3.0 |
| | | Coating aid (B) | 0.5 |
| F4 | Timing layer (1) | Polymer latex (1) | 0.96 |
| | | Polymer latex (2) | 0.64 |
| F3 | Inter-mediate layer | Poly(2-hydroxyethyl methacrylate) | 0.4 |
| F2 | Timing layer (2) | Cellulose acetate (degree of acetylation: 51.3%) | 4.27 |
| | | Styrene/maleic anhydride (1:1 by mole) copolymer (average molecular weight: 10,000) | 0.23 |
| F1 | Neutraliz-ing layer | Acrylic acid/butyl acrylate (8:2 by mole) copolymer (average molecular weight: 50,000) | 22 |
| Support | | Paper having a 30 μm thick polyethylene layer on each side (total thickness: 150 μm) | |
| B1 | Light-shielding layer | Gelatin | 2.0 |
| | | Carbon black | 4.0 |
| B2 | White reflecting layer | Gelatin | 1.0 |
| | | Titanium oxide | 8.0 |
| B3 | Protective layer | Gelatin | 0.6 |

Mordant (A):

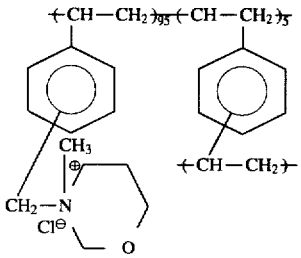

Coating Aid (B):

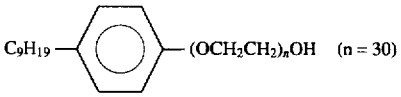

Polymer latex (1):

Styrene/butyl acrylate/acrylic acid/N-methylolacrylamide (49.7/42.3/4/4 by weight) copolymer Polymer latex (2):

Methyl methacrylate/acrylic acid/N-methylolacrylamide (93/3/4 by weight) copolymer Formulation of Alkali Processing Solution:

1-p-Tolyl-4-hydroxymethyl-4-methyl-3-pyrazolidone 6.9 g

Methylhydroquinone 0.3 g

5-Methylbenzotriazole 3.5 g

Sodium sulfite (anhydrous) 0.2 g

Sodium carboxymethyl cellulose 58 g

Potassium hydroxide (28% aqueous solution) 200 cc

Benzyl alcohol 1.5 cc

Water 835 cc

REFERENCE EXAMPLE 5

Five milliliters of a solution containing 0.1 g of each of tertiary amine latex polymers having a repeating unit of formula (I), M-17 to M-26, adjusted to pH 12±0.1 with potassium carbonate and potassium hydroxide, were added dropwise to 45 ml of a 2M potassium chloride solution. After stirring for 10 minutes, the resulting mixed solution was allowed to stand for 1 day. The stability of the latex polymer was evaluated by observing sedimentation and rated based on the following standard.

Bad . . . Sedimentation occurred in the whole system.

Medium . . . Sedimentation occurred in part of the system.

Good . . . No sedimentation occurred.

The same test was carried out except for further adding each of the oligomers or polymers of the present invention, P-2, P-30, P-51, P-52 and P-56, in an amount of 20% by weight based on the latex. The results obtained are shown in Table 8.

TABLE 8

Stability of Latex Polymer Against Sedimentation

| Latex | Oligomer or Polymer of the Invention | | | | | |
|---|---|---|---|---|---|---|
| Polymer | none | P-2 | P-30 | P-51 | P-52 | P-56 |
| M-17 | medium | good | good | good | good | good |
| M-18 | medium | good | good | good | good | good |
| M-19 | medium | good | good | good | good | good |
| M-20 | bad | good | good | good | good | good |
| M-21 | bad | good | good | good | good | good |
| M-22 | bad | good | good | good | good | good |
| M-23 | bad | good | good | good | good | good |
| M-24 | bad | good | good | good | good | good |
| M-25 | bad | good | good | good | good | good |
| M-26 | bad | good | good | good | good | good |

It is apparent that the oligomer or polymer of the present invention greatly improves the stability of the tertiary amine latex polymer having the repeating unit of formula (I) against salting out. The results of M-17 to 21 show the effect of the anionic group represented by formula (II) on stability against salting out, and yet the effect of the oligomer or polymer of the present invention is more outstanding. It is seen that the effect of the oligomer or polymer does not depend on the anionic group content of the tertiary amine polymer latex.

REFERENCE EXAMPLE 6

Neutral gelatin solutions of a tertiary amine polymer latex were prepared as follows.

A hundred milliliters of a 10% aqueous gelatin solution and 100 ml of an aqueous dispersion containing 5 g, on a solid basis, of latex polymer M-21 were mixed. On adjusting the pH of the mixture to 7.0, yogurt-like coagulum was formed, failing to provide a uniform solution.

Then, 100 ml of a mixed solution containing 5 g, on a solid basis, of latex polymer M-21 and 9 g, on a solid basis, of compound P-56 of the present invention was mixed with 100 ml of a 10% aqueous gelatin solution. On adjusting the pH to 7.0, there was formed a uniform solution. The same result was obtained in the cases of using P-2, P-16, P-18, P-30, P-37, P-51 and P-52 in place of P-56 and also in the cases of using M-22 to M-26 in place of M-21. These results prove the combination of the tertiary amine polymer and the oligomer or polymer of the present invention effective in the preparation of neutral colloid solutions.

REFERENCE EXAMPLE 7

A highly viscous alkali processing solution (PA) was prepared according to the following formulation and packed in destroyable containers.

Formulation of Processing Solution PA:

1-p-Tolyl-4-hydroxymethyl-4-methyl-3-pyrazolidone 10.0 g

Methylhydroquinone 0.18 g

5-Methylbenzotriazole 3.0 g

Sodium sulfite (anhydrous) 0.2 g

Benzyl alcohol 1.5 cc

Sodium carboxymethyl cellulose 58 g

Carbon black 150 g

Potassium hydroxide (28% aqueous solution) 200 cc

Water 680 cc

Processing solution PB was prepared in the same manner as for processing solution PA except for additionally using 18 g, on a solid basis, of latex polymer M-21 and correcting the amount of water so as to make the total volume equivalent.

Processing solution PC was prepared in the same manner as for processing solution PB except that the solution further contained 1.8 g of compound P-56 according to the present invention.

Thirty cubic centimeters of each of processing solutions PA, PB and PC were filtered through a filter having an effective area of 0.78 $cm^2$ and a pore size of 30 μm at a flow rate of 0.33 cc/min. Processing solution PB showed a marked increase in filtration pressure and could not be filtered through to the end. Processing solutions PA and PC showed only a slight increase in filtration pressure. It is seen from these results that the latex polymer can be used in a processing solution in a stable manner by using the oligomer or polymer of the present invention in combination.

Processing solutions prepared in the same manner as for PC, except for using each of M-22 to M-26 in place of M-21, or using P-2, P-16, P-18, P-30, P-36, P-37, P-51 or P-52 in place of P-56 showed similar results when tested in the same manner as described above.

EXAMPLE 4

Light-sensitive element 401 was prepared according to the layer structure shown in Table 9.

TABLE 9

Construction of Comparative Light-Sensitive Element 401

| Layer No. | Function | Components | Coating Weight ($g/m^2$) |
|---|---|---|---|
| 24 | Protective layer | Gelatin | 0.26 |
| | | Additive (1) | 0.08 |
| | | Matting agent (1) | 0.05 |
| | | Hardening agent (1) | 0.07 |
| 23 | UV absorbing layer | Gelatin | 0.48 |
| | | UV absorbent (1) | 0.09 |
| | | UV absorbent (2) | 0.08 |
| | | Additive (3) | 0.08 |
| 22 | Yellow-sensitive layer (high-sensitive) | Internal latent image type direct positive emulsion (octahedral grains; grain size: 1.4 μm) | 0.60-Ag |
| | | Sensitizing dye (3) | $1.3 \times 10^{-3}$ |
| | | Sensitizing dye (4) | $3.3 \times 10^{-4}$ |
| | | Nucleating agent (1) | $8.0 \times 10^{-8}$ |
| | | Additive (2) | $3.6 \times 10^{-2}$ |
| | | Additive (4) | $9.4 \times 10^{-4}$ |
| | | Additive (5) | $6.6 \times 10^{-6}$ |
| | | Gelatin | 0.90 |
| 21 | Yellow-sensitive layer (middle-sensitive) | Internal latent image type direct positive emulsion (octahedral grains; grain size: 1.0 μm) | 0.11-Ag |
| | | Sensitizing dye (3) | $3.3 \times 10^{-4}$ |
| | | Sensitizing dye (4) | $8.5 \times 10^{-5}$ |
| | | Nucleating agent (1) | $2.0 \times 10^{-8}$ |
| | | Additive (2) | $9.2 \times 10^{-3}$ |
| | | Additive (4) | $2.4 \times 10^{-4}$ |
| | | Additive (5) | $1.7 \times 10^{-6}$ |
| | | Gelatin | 0.20 |
| 20 | Yellow-sensitive layer (low-sensitive) | Internal latent image type direct positive emulsion (octahedral grains; grain size: 0.7 μm) | 0.11-Ag |
| | | Sensitizing dye (3) | $4.8 \times 10^{-4}$ |
| | | Sensitizing dye (4) | $1.2 \times 10^{-4}$ |
| | | Nucleating agent (1) | $2.9 \times 10^{-8}$ |
| | | Additive (2) | $1.3 \times 10^{-2}$ |
| | | Additive (4) | $3.5 \times 10^{-4}$ |
| | | Additive (5) | $2.4 \times 10^{-6}$ |
| | | Gelatin | 0.20 |
| 19 | White reflecting layer | Titanium dioxide | 1.10 |
| | | Additive (1) | $4.2 \times 10^{-2}$ |
| | | Gelatin | 0.29 |
| 18 | Yellow dye layer | Yellow dye-releasing compound (1) | 0.47 |
| | | High-boiling organic solvent (1) | $9.4 \times 10^{-2}$ |
| | | Additive (1) | $1.4 \times 10^{-2}$ |
| | | Gelatin | 0.42 |
| 17 | Intermediate layer | Gelatin | 0.23 |
| | | Matting agent (1) | 0.10 |
| 16 | Color mixing preventive layer | Additive (1) | 0.90 |
| | | Polymethyl methacrylate | 0.25 |
| | | Gelatin | 0.51 |
| 15 | Green-sensitive layer (high-sensitive | Emulsion D | 0.54-Ag |
| | | Sensitizing dye (2) | $1.2 \times 10^{-3}$ |
| | | Sensitizing dye (3) | $1.0 \times 10^{-3}$ |
| | | Nucleating agent (1) | $3.9 \times 10^{-8}$ |
| | | Additive (2) | $7.2 \times 10^{-2}$ |
| | | Additive (4) | $2.6 \times 10^{-3}$ |
| | | Additive (5) | $5.0 \times 10^{-6}$ |
| | | Gelatin | 1.10 |
| 14 | Green-sensitive layer (middle-sensitive) | Internal latent image type direct positive emulsion (octahedral grains; grain size: 1.0 μm) | 0.11-Ag |
| | | Sensitizing dye (2) | $7.2 \times 10^{-5}$ |
| | | Sensitizing dye (3) | $5.6 \times 10^{-5}$ |
| | | Nucleating agent (1) | $1.2 \times 10^{-8}$ |
| | | Additive (2) | $1.6 \times 10^{-2}$ |
| | | Additive (4) | $2.0 \times 10^{-4}$ |
| | | Gelatin | 0.23 |
| 13 | Green-sensitive layer (low-sensitive) | Internal latent image type direct positive emulsion (octahedral grains; grain size: 0.7 μm) | 0.11-Ag |
| | | Sensitizing dye (2) | $1.0 \times 10^{-4}$ |
| | | Sensitizing dye (3) | $8.1 \times 10^{-5}$ |
| | | Nucleating agent (1) | $1.7 \times 10^{-8}$ |

TABLE 9-continued

Construction of Comparative Light-Sensitive Element 401

| Layer No. | Function | Components | Coating Weight ($g/m^2$) |
|---|---|---|---|
| | | Additive (2) | $2.3 \times 10^{-2}$ |
| | | Additive (4) | $2.8 \times 10^{-4}$ |
| | | Gelatin | 0.23 |
| 12 | White reflecting layer | Titanium dioxide | 1.60 |
| | | Additive (1) | $6.3 \times 10^{-2}$ |
| | | Gelatin | 0.44 |
| 11 | Magenta dye layer | Magenta dye-releasing compound (1) | 0.35 |
| | | High-boiling organic solvent (1) | $7.0 \times 10^{-2}$ |
| | | Additive (1) | $1.7 \times 10^{-4}$ |
| | | Gelatin | 0.20 |
| 10 | Intermediate layer | Gelatin | 0.29 |
| | | Matting agent (1) | 0.06 |
| 9 | Color mixing preventive layer | Additive (1) | 1.70 |
| | | Polymethyl methacrylate | 0.43 |
| | | Gelatin | 0.86 |
| 8 | Red-sensitive layer (high-sensitive) | Emulsion D | 0.42-Ag |
| | | Additive (6) | $9.0 \times 10^{-5}$ |
| | | Sensitizing dye (1) | $1.1 \times 10^{-3}$ |
| | | Nucleating agent (1) | $8.5 \times 10^{-8}$ |
| | | Additive (2) | $3.9 \times 10^{-2}$ |
| | | Additive (4) | $2.0 \times 10^{-3}$ |
| | | Gelatin | 0.43 |
| 7 | Red-sensitive layer (middle-sensitive) | Internal latent image type direct positive emulsion (octahedral grains; grain size: 1.0 μm) | 0.15-Ag |
| | | Sensitizing dye (1) | $1.5 \times 10^{-4}$ |
| | | Nucleating agent (1) | $6.9 \times 10^{-8}$ |
| | | Additive (2) | $1.8 \times 10^{-2}$ |
| | | Additive (4) | $5.6 \times 10^{-4}$ |
| | | Gelatin | 0.53 |
| 6 | Red-sensitive layer (low-sensitive) | Internal latent image type direct positive emulsion (octahedral grains; grain size: 0.7 μm) | 0.15-Ag |
| | | Sensitizing dye (1) | $2.1 \times 10^{-4}$ |
| | | Nucleating agent (1) | $9.9 \times 10^{-8}$ |
| | | Additive (2) | $2.5 \times 10^{-2}$ |
| | | Additive (4) | $8.0 \times 10^{-4}$ |
| | | Gelatin | 0.53 |
| 5 | White reflecting layer | Titanium dioxide | 3.40 |
| | | Gelatin | 0.84 |
| 4 | Cyan dye layer | Cyan dye-releasing compound (1) | 0.36 |
| | | High-boiling organic solvent (1) | $3.0 \times 10^{-2}$ |
| | | Additive (2) | $3.0 \times 10^{-2}$ |
| | | Gelatin | 0.4 |
| 3 | Opaque layer | Carbon black | 1.70 |
| | | Gelatin | 1.70 |
| 2 | White reflecting layer | Titanium dioxide | 22.00 |
| | | Gelatin | 2.75 |
| 1 | Image-receiving layer | Polymer mordant (1) | 3.00 |
| | | Gelatin | 3.00 |
| Support | | Polyethylene terephthalate (thickness: 150 μm) | |

The compounds used in light-sensitive element 401 are shown below. See Example 1 as for those also used in Example 1.

Additive (3):

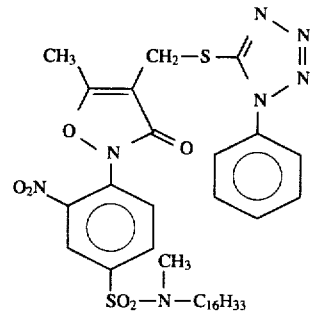

Additive (4):

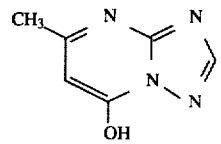

Additive (5):

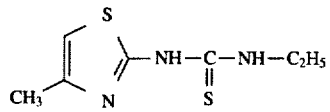

Additive (6):

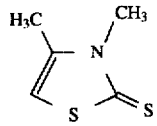

High-Boiling Organic Solvent (1):
Tricyclohexyl phosphate

Hardening Agent (1):

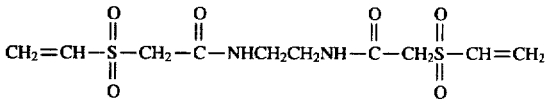

Sensitizing Dye (4):

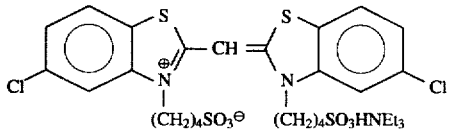

Emulsion D used in 8th and 15th layers (hexagonal tabular internal latent image type direct positive emulsion) was prepared as follows. A 1.4M aqueous silver nitrate solution containing gelatin having an average molecular weight of not more than 100,000 and a 2M aqueous potassium bromide solution were simultaneously added each at a rate of 33 cc/min to 1.2 l of an aqueous solution containing 0.05M potassium bromide and 0.7% by weight gelatin of the same species as described above while vigorously stirring according to a double jet process. During the addition, the aqueous gelatin solution was kept at 30° C. Then, 300 cc of a 10% by weight aqueous solution containing deionized gelatin having a Ca content of not higher than 100 ppm was added thereto, and the mixture was heated to 75° C.

Thereafter, 40 cc of a 0.9M aqueous solution of silver nitrate was added to the mixture over 3 minutes, and 25% by weight aqueous ammonia was added thereto, followed by ripening at 75° C. After completion of the ripening, ammonia was neutralized, and an aqueous solution containing 5 mg of lead acetate was added thereto. A 1M aqueous silver nitrate solution and a 1M aqueous potassium bromide solution were added to the mixture each at an increasing rate so that the final rate might be 6 times the initial one while maintaining the pBr at 2.5 in accordance with a double jet process. The total amount of the aqueous silver nitrate solution added was 500 cc.

The thus formed core particles were washed by a flocculation method in a conventional manner, and gelatin, 2-phenoxyethanol, and methyl p-hydroxybenzoate were added thereto to obtain 750 g of hexagonal tabular core particles.

The resulting core particles had an average projected area circle-equivalent diameter of 0.9 μm and an average thickness of 0.20 μm, and hexagonal tabular particles occupied 95% of the total projected area.

To 200 g of the hexagonal tabular core particles emulsion were added 1300 cc of water, 0.11M potassium bromide, and 40 g of deionized gelatin. After heating to 75° C., 0.3 g of 3,6-dithia-1,8-octanediol, 10 mg of sodium benzenethiosulfate, 2.4 cc of an aqueous solution of 90 mg of potassium tetrachloroaurate and 1.2 g of potassium bromide in 1000 cc of water, and an aqueous solution of 15 mg of lead acetate were added to the emulsion, and the emulsion was kept at 75° C. for 180 minutes for chemical sensitization. To the thus chemically sensitized emulsion were added a 2M aqueous silver nitrate solution and a 2.5M aqueous potassium bromide solution each at an increasing rate so that the final rate might be 3 times the initial one while controlling the rate of addition of the aqueous potassium bromide solution so as to keep the pBr at 2.5 in accordance with a double jet process. The total amount of the aqueous silver nitrate solution added was 810 cc.

After a 0.3M potassium bromide solution was added, the emulsion was washed by a flocculation method in a conventional manner, and gelatin was added thereto to obtain a hexagonal tabular internal latent image type core/shell emulsion. The resulting hexagonal tabular grains had an average projected area circle-equivalent diameter of 2.5 μm, an average thickness of 0.37 μm, and an average volume of 1.4 $\mu m^3$, and hexagonal tabular grains occupied 88% of the total projected area.

To the emulsion were added 15 cc of an aqueous solution containing 100 mg of sodium thiosulfate and 40 mg of sodium tetraborate and then 20 mg of poly(N-vinylpyrrolidone), followed by heating at 60° C. for 100 minutes for chemical sensitization of the grain surface.

Light-sensitive elements 402 to 405 were prepared in the same manner as for 401, except that a dye-capturing layer having the following composition was provided between the 23rd layer and the 24th layer.

Composition of Dye-Capturing Layer:

Sample 402: 0.5 $g/m^2$ of gelatin

Sample 403: 0.5 $g/m^2$ of gelatin and 1.2 $g/m^2$ of M-21

Sample 404: 0.5 $g/m^2$ of gelatin, 1.2 $g/m^2$ of M-21, and 0.24 $g/m^2$ of P-30

Sample 405: 0.5 $g/m^2$ of gelatin, 1.2 $g/m^2$ of M-21, and 0.24 $g/m^2$ of P-56

Light-sensitive element 403 was unsuitable as a test sample due to non-uniform surface after coating. Light-sensitive elements 404 and 405 containing the combination according to the present invention had a uniform coating surface.

Each of light-sensitive elements 402, 404, and 405 was exposed to light through a continuous wedge from the emulsion layer side. A cover sheet (neutralization timing element) prepared in the same manner as in Example 1 was superposed thereon, and a processing solution prepared in the same manner as in Example 1 was spread therebetween to a thickness of 72 μm by means of a pressure roller at 25° C. One hour later, the magenta reflective density was measured with a color densitometer. The magenta reflective densities of light-sensitive elements 402, 404, and 405 were 2.05, 1.95, and 1.94, respectively. The magenta reflective densities of these samples as measured again after preservation at 40° C. and 70% RH for 3 days were 2.42, 2.18, and 2.17, respectively. It is seen from these results that the combination of a tertiary amine polymer latex and the oligomer or polymer according to the present invention reduces variation of image density after processing.

EXAMPLE 5

The same procedure as in Example 4 was followed, except for using light-sensitive element 401 and processing solutions PA, PB or PC prepared in Reference Example 7. As a result, the magenta reflective density of the sample processed with PA, PB or PC after 1 hour from the spreading of the processing solution was 2.08, 2.00 or 1.97, respectively, which changed to 2.46, 2.21, or 2.11, respectively, after 3 days' preservation at 40° C. and 70% RH. These results prove that processing solutions PB and PC suppress variation of image density after processing. However, when the test using processing solution PB was repeated several times, the performance of processing solution PB was so instable that the results were non-uniform such as 1.94, 2.02, 1.98, and 1.97 as the magenta density measured after 1 hour from the spreading of the processing solution, which changed to 2.15, 2.24, 2.19, and 2.22, respectively. Seeing that processing solutions PA and PC gave results with good reproducibility, such performance instability seems to be peculiar to processing solution PB. Considering the above results combined with the results of Reference Example 7, processing solution PB suffers from coagulation of the tertiary amine polymer latex, which seems to make the spread of the processing solution non-uniform. To the contrary, since such non-uniform spread does not occur in the case of processing solution PC according to the present invention so that the variation in image density after processing can be reduced.

EXAMPLE 6

Light-sensitive element 401 of Example 4 was processed in the same manner as in Example 4, except for using a processing solution prepared by adding, to processing solution PA of Reference Example 7, 1.8 g, on a solid basis, of the oligomer or polymer shown in Table 10 and 18 g, on a solid basis, of a tertiary amine polymer shown in Table 10.

Each processing solution was filtered using a filter having an effective area of 0.88 $m^2$ and a pore size of 30 μm at a rate of 0.33 cc/min. The filtration pressure was measured after 10 minutes ($P_{10}$) and 90 minutes ($P_{90}$) from the start of filtration to obtain a rate of filtration pressure increase, $(P_{90}-P_{10})/P_{10}$.

The variation of magenta density after processing was obtained in the same manner as in Example 5.

The results obtained are shown in Table 10.

TABLE 10

| Run No. | Oligomer or Polymer | Tertiary Amine Polymer | Rate of Filtration Pressure Increase | Magenta Density After Spreading: 1 Hour | Magenta Density After Spreading: 40° C., 70% RH × 3 Days |
|---|---|---|---|---|---|
| | | (Comparison) | | | |
| 601 | — | — | 0.22 | 2.06 | 2.43 |
| 602 | — | M-25 | unmeasurable | — | — |
| | | (Invention) | | | |
| 603 | P-2 | M-25 | 0.42 | 1.93 | 2.05 |
| 604 | P-16 | " | 0.40 | 1.90 | 2.02 |
| 605 | P-18 | " | 0.55 | 1.94 | 2.05 |
| 606 | P-30 | " | 0.28 | 1.87 | 2.01 |
| 607 | P-51 | " | 0.35 | 1.91 | 2.03 |
| 608 | P-52 | " | 0.29 | 1.93 | 2.04 |
| 609 | P-56 | " | 0.28 | 1.89 | 2.08 |
| 610 | " | M-17 | 0.26 | 1.89 | 2.14 |
| 611 | " | M-18 | 0.28 | 1.92 | 2.14 |
| 612 | " | M-19 | 0.27 | 1.93 | 2.13 |
| 613 | " | M-20 | 0.30 | 1.95 | 2.11 |
| 614 | " | M-21 | 0.32 | 1.96 | 2.10 |
| 615 | " | M-22 | 0.28 | 1.87 | 2.03 |
| 616 | " | M-23 | 0.30 | 1.89 | 2.01 |
| 617 | " | M-24 | 0.31 | 1.92 | 2.02 |
| 618 | " | M-25 | 0.33 | 1.93 | 2.04 |
| 619 | " | M-26 | 0.45 | 1.95 | 2.03 |
| 620 | " | M-27 | 0.35 | 1.93 | 2.02 |
| 621 | " | M-28 | 0.48 | 1.91 | 2.03 |
| 622 | " | M-29 | 0.33 | 1.90 | 2.02 |

In Run No. 602 (Comparison) the processing solution was non-uniform and unfilterable. In Run Nos. 603 to 622 according to the combination of the present invention, uniform processing solutions were obtained, and variation in magenta density after processing was greatly reduced as compared with Run No. 601.

On comparing the tertiary amine polymers used in Run Nos. 610 to 614 with those used in Run Nos. 615 to 622, the polymers having an amido linkage between the tertiary amino group and the polymer main chain have a great effect on suppression of magenta density variation, and the effect on suppression of magenta density variation becomes higher as the content of the carboxylic acid moiety as a copolymerization component decreases. It is thus seen that an increase in proportion of the carboxylic acid moiety in the tertiary amine polymer, though effective to prevent coagulation of a processing solution, tends to lessen the effect on suppression of magenta density variation. The use of the oligomer or polymer having surface activity in combination with the tertiary amine polymer makes it possible to reduce the proportion of the carboxylic acid moiety in the tertiary amine polymer and is yet effective to prevent coagulation of a processing solution while suppressing density variation after image formation.

On comparing the tertiary amine polymers of Run Nos. 621, 620, 617, and 622, it can be understood that there is an optimum proportion of a styrene moiety to be present as a copolymerization component in the tertiary amine polymer in order to minimize the density variation.

As has been fully described and demonstrated, the present invention provides a color diffusion transfer film unit which provides a high quality photograph at a high rate of image formation and which suppresses variation of image density after image formation. The present invention further provides a color diffusion transfer film unit containing a small amount of a photographically useful substance in a stable state.

While the invention has been described in detail and with reference to specific examples thereof, it will be apparent to one skilled in the art that various changes and modifications can be made therein without departing from the spirit and scope thereof.

What is claimed is:

1. A color diffusion transfer film unit comprising an alkali processing element and a light sensitive silver halide element comprising dye image-forming substances and dye image receiving elements or layers as elements constituting said film unit, wherein said alkali processing element contains a tertiary amine polymer and at least one oligomer or polymer having surface activity.

2. A color diffusion transfer film unit as claimed in claim 1, wherein at least one of said elements contains a white or black pigment and at least one oligomer or polymer having surface activity.

3. A color diffusion transfer film unit as claimed in claim 1, wherein said oligomer or polymer having surface activity is used in an amount of 0.01 to 10% by weight based on an alkali processing component.

4. A color diffusion transfer film unit as claimed in claim 1, wherein said oligomer or polymer having surface activity is one comprising at least two groups selected from the groups of a hydrophobic group, a hydrophilic nonionic functional group, and an anionic functional group or a salt thereof.

5. A color diffusion transfer film unit as claimed in claim 4, wherein said oligomer or polymer having surface activity is a random copolymer, a block copolymer or a graft copolymer.

6. A color diffusion transfer film unit as claimed in claim 4, wherein said oligomer or polymer having surface activity has $1\times10^3$ to $1\times10^6$ of weight average molecular weight.

7. A color diffusion transfer film unit as claimed in claim 5, wherein said oligoner or polymer having surface activity has $1\times10^3$ to $1\times10^6$ of weight average molecular weight.

8. A color diffusion transfer film unit as claimed in claim 4, wherein said oligomer or polymer having surface activity is a random copolymer, a block copolymer or a graft copolymer, and has $1\times10^3$ to $1\times10^6$ of weight average molecular weight.

9. A color diffusion transfer film unit as claimed in claim 1, wherein said tertiary amine polymer comprises a repeating unit represented by formula (I):

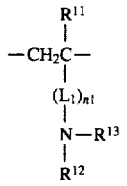

wherein $R^{11}$ represents a hydrogen atom or an alkyl group; $R^{12}$ and $R^{13}$ each represent an alkyl group, an aralkyl group, an alkenyl group or an alkynyl group; $L_1$ represents a divalent linking group; $n_1$ represents 0 or 1; and $R^{12}$, $R^{13}$, and $L_1$ may be taken together to form a ring.

10. A color diffusion transfer film unit as claimed in claim 1, wherein said oligomer or polymer having surface activity is used in an amount of 1/1000 to equivalent weight of the solid weight of the tertiary amine polymer.

* * * * *